United States Patent [19]

Tomisawa

[11] 4,127,047

[45] Nov. 28, 1978

[54] METHOD OF AND APPARATUS FOR COMPOSING DIGITAL TONE SIGNALS

[75] Inventor: Norio Tomisawa, Hamamatsu, Japan

[73] Assignee: Nippon Gakki Seizo Kabushiki Kaisha, Hamamatsu, Japan

[21] Appl. No.: 817,666

[22] Filed: Jul. 21, 1977

[30] Foreign Application Priority Data

Jul. 24, 1976 [JP] Japan ..... 51-88431

[51] Int. Cl.[2] ..... G10H 1/00

[52] U.S. Cl. ..... 84/1.01; 84/1.03; 84/1.13; 328/14; 307/261

[58] Field of Search ..... 84/1.01, 1.03, 1.13; 328/14; 307/261

[56] References Cited

U.S. PATENT DOCUMENTS

| | | | |
|---|---|---|---|
| 3,458,729 | 7/1969 | Klein | 307/261 |
| 3,578,985 | 5/1971 | Edson | 307/261 |
| 3,845,396 | 10/1974 | Rutman | 328/14 |
| 3,925,654 | 12/1975 | Roantree | 328/14 |
| 3,983,493 | 9/1976 | Gladstone | 328/14 |
| 3,984,771 | 10/1976 | Nossen | 328/14 |

*Primary Examiner*—Robert K. Schaefer
*Assistant Examiner*—Leonard W. Pojunas, Jr.
*Attorney, Agent, or Firm*—Koda and Androlia

[57] ABSTRACT

Upon key depression, there is produced a phase progress signal in digital representation which varies by an increment predetermined in accordance with the frequency of the note designated by the depressed key. The phase progress signal is subjected to a coordinate conversion and squaring operation to provide downward opening parabolic curves and upwardly opening parabolic curves, which are alternately connected at their open ends to produce an approximate sinusoidal waveform as a digital tone signal. The digital tone signal is multiplied by a digital envelope signal to produce a keyed musical tone signal.

6 Claims, 26 Drawing Figures

FIG. 1
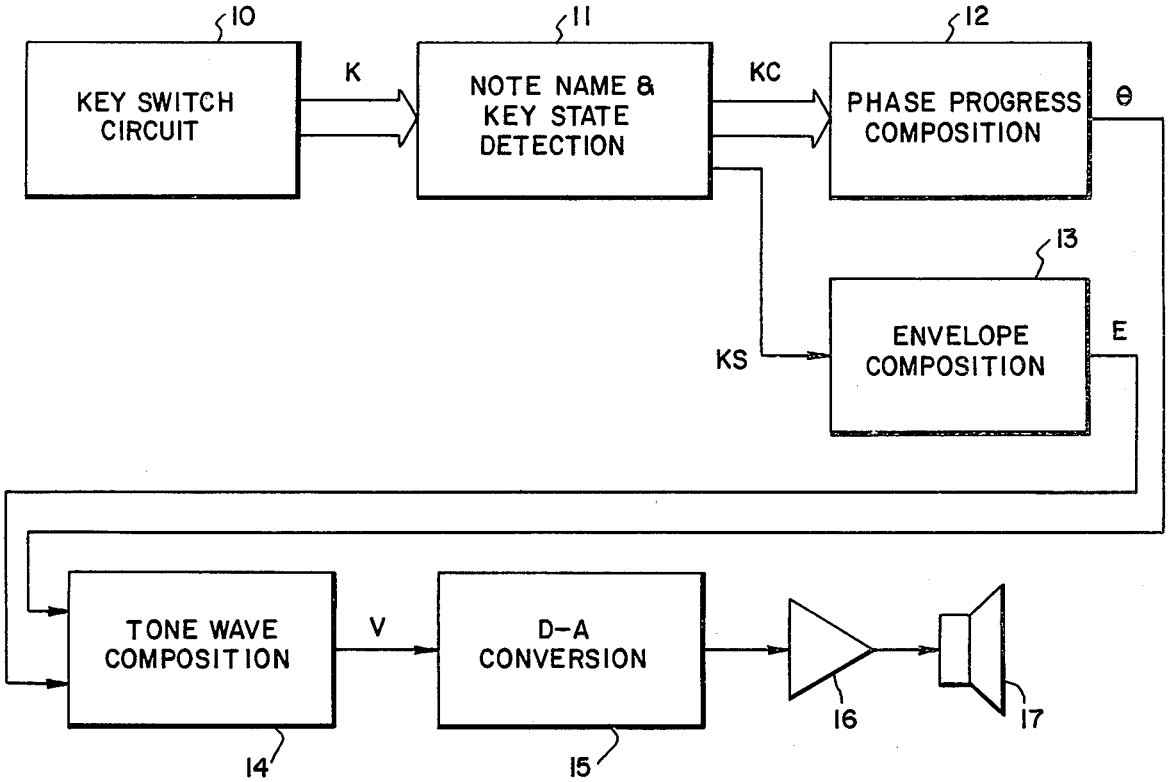
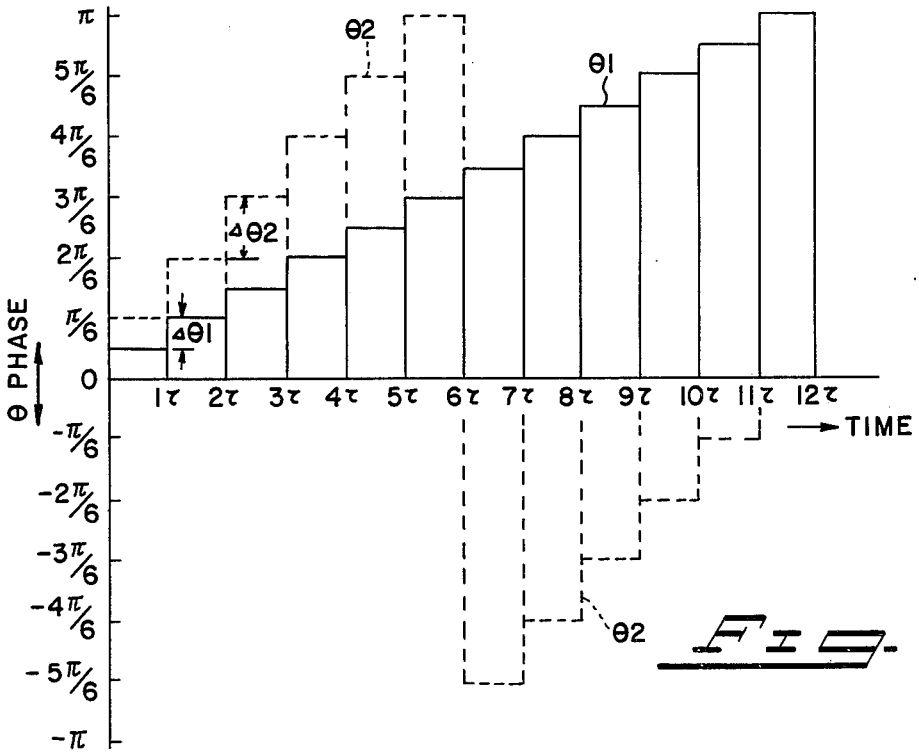
FIG. 2

Ø
1μs
16μs
8μs
8μs
Y1
Y1-8
Y9
Y1,-9
Y8-16
Y16
Y
T1
T2
T3

METHOD OF AND APPARATUS FOR COMPOSING DIGITAL TONE SIGNALS

BACKGROUND OF THE INVENTION

1.Field of the Invention

This invention relates generally to a method of and an apparatus for composing digital tone signals, and more particularly to a digital tone composing system capable of composing a tone signal of digital representation.

2. Prior Art

According to the prior art, there has been proposed a tone composing system in which a waveform is stored in a memory such as a read-only memoty (ROM) in the form of an amplitude value or an increment value of the amplitude at each sampling point and it is read out with a frequency corresponding to the number of sample points N times $f$ ($f$ being the frequency of the tone to be pronounced) whereby the desired digital tone signal is obtained. Such a digital tone signal representation with for example a binary code is modulated by a digital signal which indicates the keying envelope as necessary, then converted to the corresponding analog signal through a D-A converter circuit, amplified and sounded. Such a tone composing system is advantageous in that the desired digital tone can be obtained easily by storing in a ROM various waveforms to be sounded. On the other hand, a large capacity ROM is needed for the storage of the waveform and the hardware volume as a whole increases. Such a disadvantage is unavoidable.

SUMMARY OF THE INVENTION

It is an object of the present invention to provide a digital tone composing system capable of composing a tone signal of digital representation with minimum hardware configuration.

Another object of the present invention is to provide a digital tone composing system in which the waveforms required for composing digital tones are formed by a logical operation without being stored in ROM.

In keeping with the principles of the present invention the objects are accomplished by a unique digital tone composing system in which a tone signal is obtained by using as the tone source waveform a waveform in the form of a sinusoidal wave approximated by alternately connecting downward opening parabolic curves and upwardly opening parabolic curves at their open ends.

One of the features of the present invention resides in that a digital tone signal representing a sine wave approximated by parabolic curves is obtained by applying a coordinate conversion and a squaring operation process to a phase progress signal which varies by an increment predetermined in accordance with the frequency of the note to be produced. By multiplying the digital tone signal in the form of a sine wave by a digital envelope input which digitally represents a keying envelope, a simulation of a tone keying operation becomes possible.

In another feature of the present invention, a squaring operation for a phase progress signal, and the multiplication of a digital envelope signal and a digital tone signal, are executed in a common serial multiplier circuit. This feature, coupled with the exclusion of the use of ROM for storing waveforms, is not only effective for reducing the hardware volume, but also is significant in speeding-up the entire system.

BRIEF DESCRIPTION OF THE DRAWINGS

The above, as well as other objects, features and advantages of the invention will become apparent and better understood by reference to the following detailed description when considered in connection with the accompanying drawings wherein:

FIG. 1 is a block diagram of a digital electronic musical instrument embodying the present invention;

FIG. 2 is a graph for explaining the principle of phase composition;

FIG. 13 ia a block diagram of an electronic musical instrument according to another embodiment of the present invention.

DETAILED DESCRIPTION OF THE INVENTION

Figure 3:
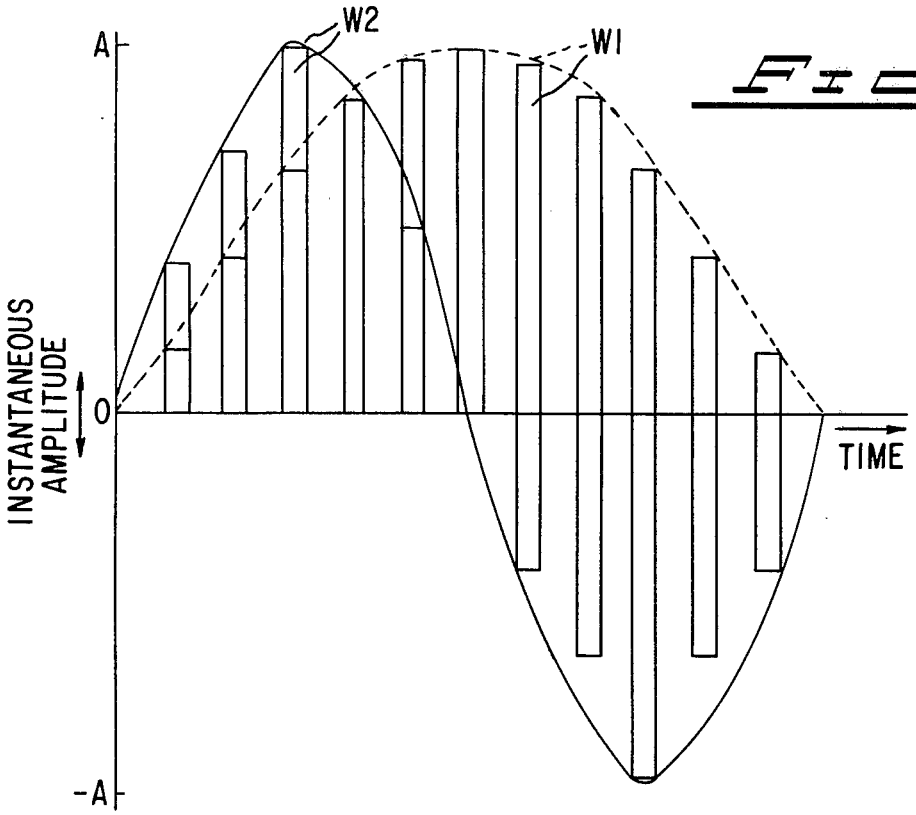
FIG. 3 is a graph for explaining the principle of waveform generation.

Referring now to FIG. 1, a key switch circuit 10 including key switches provided in correspondence to a multitude of keys. The key switches are arranged in matrix form, are scanned by a scanning circuit (not shown) and generate key data K. The key data K includes information constituting both the key code signal KC indicating which key is depressed, and key state signal KS indicative of the on/off state of the keys. These signals are distinguished from each other by note name and key state detecting means 11. The key code KC is determined separately for each not name (pitch) and allotted to each key correspondingly to each note (pitch). When a specific key is depressed, a key code signal KC indicating that key (i.e. the note name corresponding to that key) is generated from the detecting means 11, whereupon a key state signal KS indicating the on state of that key is produced.

Phase progress composing means 12 generates a digital phase progress input $\theta$ which is in corresponding relation to the specific tone frequency in response to the received key code signal KC. The digital phase progress input $\theta$ defines the sampling phase points for the waveform to be produced and varies by an increment which is predetermined according to the frequency of the note designated by the depressed key, and it corresponds to the address input in conventional apparatus of the type using ROM. On the other hand, the key state signal KS indicates the time when a key was depressed, the time when it was released, and the duration between those times, and it is fed to envelope signal E of digital representation on the basis of the signal KS. The digital envelope signal E is obtained as a digital representation of the amplitude value or increment value of amplitude of each envelope sample point.

Tone wave composing means 14 not only composes a digital tone signal by applying coordinate conversion and squaring operation process to the digital phase progress input $\theta$, but also multiplies that tone signal by the envelope signal E to put out an amplitude-modulated digital tone signal V. The tone signal V is converted to a corresponding analog signal by means of a D-A converter 15, amplified by an output amplifier 16 and sounded as a tone through an electroacoustic transducer 17.

In the above described configuration, the key switch circuit 10, detecting means 11, D-A converter 15, output amplifier 16 and electroacoustic transducer 17 may be conventional ones belonging to the prior art and are well known to those skilled in the art; therefore, details thereof are omitted here. Next, with respect to each of the phase progress composing means 12, envelope composing means 13 and tone wave composing means 14, its basic construction and operation are explained below one after another.

First, referring to FIGS. 2 and 3, the principle of phase progress composition is explained below. For convenience's sake, let us consider two cases, one of which the increment of phase progress input $\theta$ is $\Delta\theta 1$ and the other it is $\Delta\theta 2$ ($=2 \times 01$). Since the phase $\theta$ increases in constant rates $\Delta\theta 1$ and $\Delta\theta 2$ at every time $\tau$, in the case where these are digitally represented with a binary code, it can obviously be understood that such digital phase progress input $\theta$ defines the amplitude increasing in a constant ratio at every phase (or sample point). Such digital phase input $\theta$ can easily be obtained for example by storing ina ROM the amplitude increments corresponding to $\Delta\theta 1$ and $\Delta\theta 2$ and repeating the operation of succesively reading out the contents of the memory and integrating. Reference to its concrete hardware configuration will be made hereinafter.

As already mentioned, the digital phase progress input $\theta$ corresponds to the address input which is used in reading out instantaneous amplitude sample value data for constructing waveforms from a waveform storing ROM. But, what is important in this example is that the digital phase progress input $\theta$ is composed not as a mere address input but as a signal having a special relation to the frequency of the tone to be produced and it is used in the succeeding tone wave composition. On this regard, a further reference is made below. One phase progress input $\theta 1$ has its phase increment of $\Delta\theta 1$ and $\theta = \pi$ is reached at $t = 12\tau$, while the other phase input $\theta 2$ indicated with broken line has its phase increment of $2 \times \Delta\theta 1$ and $\theta = \pi$ is reached at $t = 6\tau$. Therefore, let us consider the case in which a sine waveform is read out from the waveform storing ROM using the said two phase inputs $\theta 1$ and $\theta 2$ as an address input or variable input. As shown in FIG. 3, in the case where the data of instantaneous amplitude AM at every sample point is read with phase progress input $\theta 1$, a waveform output W1 is obtained, and in the case where it is read with phase progress input $\theta 2$, a waveform output W2 is obtained. The frequency $f_{w1}$ of the read waveform W1 for the frequency $f_{w2}$ of W2 becomes $f_{w1} = f_{w2}/2$. Thus, it is seen that the frequency of the waveform read from ROM changes according to how the phase increment is determined. Consequently, if the rate of phase increase is predetermined in accordance with the frequency of the tones (which, in the above example, is determined by the relation of an octave), there can be obtained a tone signal having a digital read waveform of a frequency equivalent to the frequency of the tone to be sounded. In the present invention, instead of reading the contents of the waveform storing ROM with an address input, a logical operation is applied to the phase input corresponding to an address input to give a sine wave approximated by parabolic curves. By specifying the phase increment as above in relation to the note, the frequency of the approximated sine wave can be obtained as the equivalent to the frequency of the tone. This is the same as in the foregoing case of a reading ROM. As hereinbefore described in connection with FIG. 2, the digital phase progress input $\theta$ can be interpreted as increasing at a certain rate at every phase (or sample point). In operating the present invention, therefore, a digital phase progress input $\theta$ decreasing at a certain rate may also be used as the case may be on the condition that the operation of coordinate conversion, as will be described hereinafter, should be applied as necessary.

Figure 4:
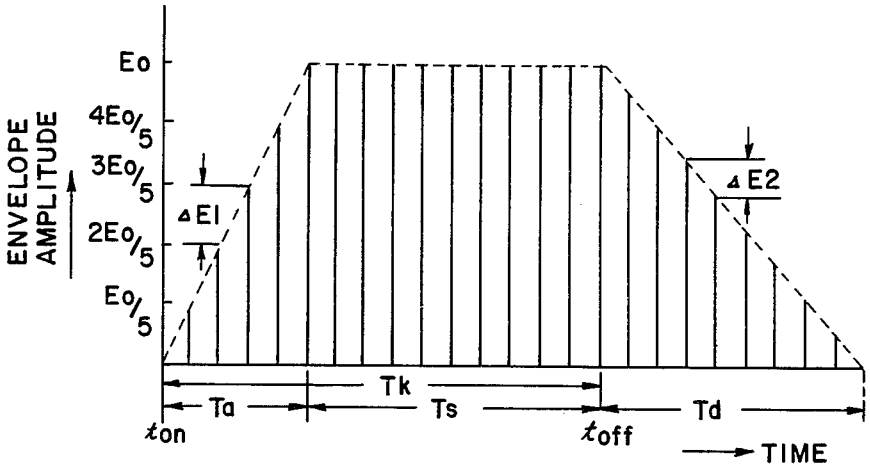
FIG. 4 is a graph for explaining the principle of envelope composition.

Referring now to FIG. 4, the principle of the envelope wavefore composition is explained. The key state signal KS, already mentioned, indicates the on-start time of a key, $t_{on}$, the on-end (off-state) time, $t_{off}$, and the duration between such times, Tk. In the composition of an envelope the envelope amplitude increments $\Delta E1$ and $\Delta E2$ at each sample point as shown in FIG. 4 are stored in an envelope storing ROM and during a certain period from the on-start point, $t_{on}$, (attack period T*a*), $\Delta E1$ is read out repeatedly and integrated to reach amplitude value Eo. During sustain period T*s*, that is the on duration T*k* minus attack period T*a*, the amplitude value Eo is sustained. During a certain period from the off-start, $t_{off}$, (decay period T*d*), $\Delta E2$ is read our repeatedly and subtracted from Eo. Through such a processing, the envelope waveform as exemplified in FIG. 4 can be obtained.

Figure 6:
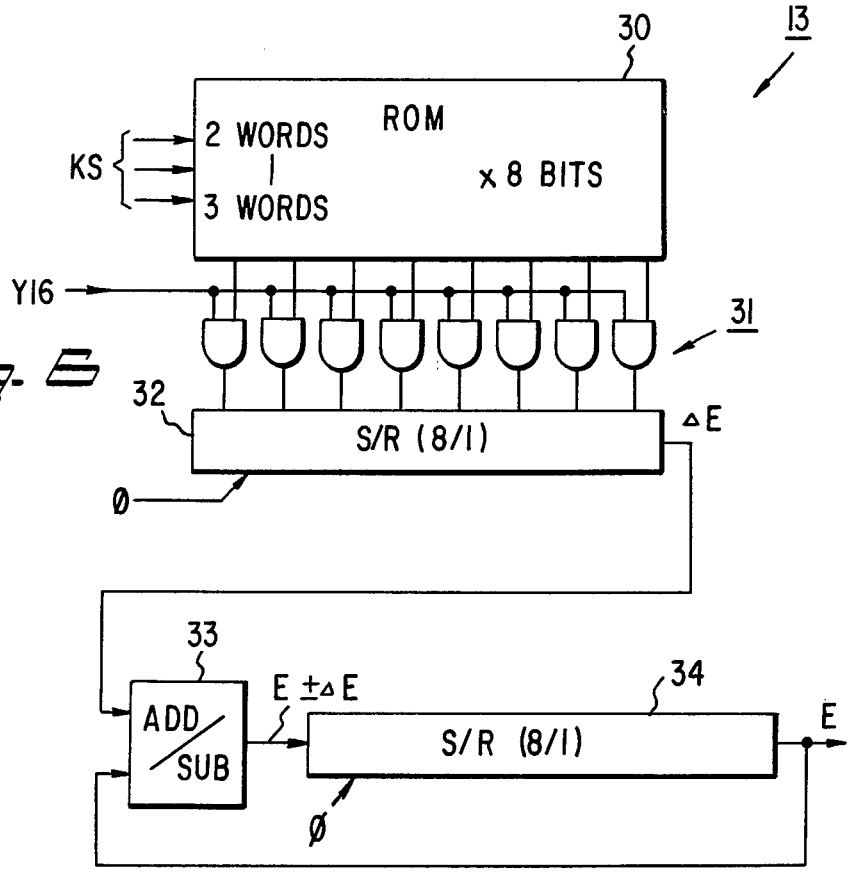
FIG. 6 is a block diagram of envelope composing means according to the principle of envelope composition shown in FIG. 4.
Figure 5:
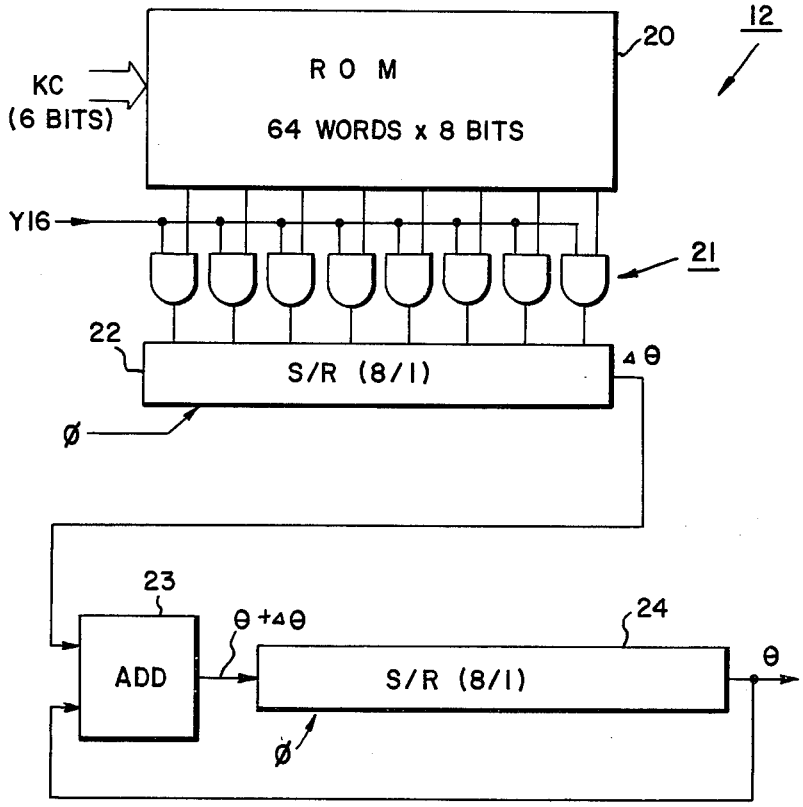
FIG. 5 is a block diagram of phase progress composing means according to the principle of phase progress composition shown in FIG. 2.

Referring now to FIGS. 5 and 6, an outline is given below of the apparatus according to the foregoing principle of phase composition and that of envelope composition.

FIG. 5 shows an example of the phase progress composing means 12 capable of being used in the system of FIG. 1. ROM 20, which receives a 6-bit key code signal KC as its address input stores 8-bit, 64-word data which indicates the phase increment $\Delta\theta$ corresponding to each key (each note name) and puts out a phase increment which specifies the frequency of the note corresponding to the key in accordance with the indication of the key code signal KC. To the 8-bit parallel output terminals of ROM 20 are connected one of the input terminals of the eight AND gates of a gate circuit 21, the other input terminals thereof receiving clock pulses Y16. The phase increment data $\Delta\theta$ read from the ROM through the gate circuit 21 is fed to the parallel input terminals of a parallel-serial converting 8-stage shift register 22 and is bit-serialwise outputted from the shift register 22 with clock pulse $\phi$. The serial phase increment data $\Delta\theta$ is then fed to the input of an adder 23 and is added to a serial feedback data $\theta$ which is from an 8-stage shift register 24 of the following stage. The added data $\theta + \Delta\theta$ flows through the shift register 24 which is timed with clock pulse $\phi$, and is fed as phase progress input $\theta$ to the tone composing means 14 of the following stage.

The apparatus of FIG. 5 operates as follows. When a specific key is depressed, the apparatus, in accordance with the indication of the key code signal KC corresponding to that key, puts out from the ROM the phase increment data $\Delta\theta$ corresponding to the tone frequency of that key (a certain word out of 64 words), converts it to serial data, repeatedly integrates such serial phase increment data $\theta$ in synchronism with the clock pulse $\phi$ following a cyclic loop of adder 23 - shift register 24 and operates so as to compose such a phase input $\theta$ as referred to above in connection with FIGS. 2 and 3. If the depressed key changes, the key code KC also changes and phase increment data $\Delta\theta$ corresponding to another tone frequency is composed as phase progress input in the same manner.

FIG. 6 shows an example of the envelope composing means 13 which can be utilized in the system of FIG. 1. Each 8-bit 2–3 word envelope increment data is stored in the ROM and is read out according to the indication of, for example, the 3-bit key state signal KS as its address input. At the 8-bit parallel output terminals is disposed a gate circuit 31 including eight AND gates of the same construction as that already mentioned. The read timing of parallel increment data is controlled by clock pulses Y16. The read data is fed to the parallel input terminals of a parallel-serial converting 8-stage shift register 32 and are read out as serial increment data $\Delta\theta$ from the serial output terminal in synchronism with clock pulse $\phi$. The serial increment data $\Delta\theta$ is repeatedly added or subtracted in a cyclic loop composed of adder/subtracter 33 and 8-stage shift register 34 to compose such a digital envelope signal E as exemplified in FIG. 4. The envelope signal E is transmitted to the tone wave composing means 14 of the following stage in synchronism with clock pulse $\phi$. The addition in adder/subtracter 33 is carried out during the attack period T*a*, while the subtraction is made during the decay period T*d*, and neither processing is done during the sustain period T*s*. During the sustain period T*s*, data of amplitude Eo as shown in FIG. 4 are outputted repeatedly.

Referring now to FIGS. *7a* through *7f*, a series of processes for composing an approximated sine wave by the application of a coordinate conversion and squaring operation are explained. In these figures, the axis of the abscissa shows the phase of 0 to $2\pi$ with respect to each of quadrants I through IV, while the axis of the ordinate shows amplitude normalized to unity.

The phase progress input or variable input consists of binary codes (of five digits in this embodiment) expressed in a two's complement representation where the negative values are expressed by the respective complements against the ninth power of 2 ($2^5 = 32$ in this embodiment) with the most significant bit (MSB) serving as a sign bit. Thus, the phase progress input used is a digital value and not an analog or continuous value. For the convenience of explanation, however, the following explanation is given on the assumption that in FIGS. *7a* through *7f* the amplitude changes continuously as the phase changes. On this premise, in FIG. *7a*, the phase input is shown as straight lines A and B having a constant inclination. These right-up straight lines show that the amplitude of each phase increases at a constant rate.

Regarding the phase progress input approximated by the straight lines A and B, as shown in FIG. *7b*, a one's complements (complements against 11111 in binary notation) taken only with respect to the data of Quadrants I and III and a coordinate conversion is done. By this processing, the straight lines A and B change as indicated with straight lines A1, A2 and B1, B2 respectively. The detection of Quadrants I and III is made by checking that the second bit from the left of the phase input binary code, that is, the second most significant bit (SMSB) is "0".

Next, with MSB and SMSB made "0", the absolute value of the amplitude is extracted. FIG. *7c* shows the change in the absolute value of amplitude using the connection of straight lines A3, A4, B3 and B4.

The absolute value of amplitude is then doubled, with the amplitude changing as indicated with straight lines A5, A6, B5 and B6 of FIG. *7d*. This process is applied for increasing the degree of approximation of sine wave by a square curve. The process of FIG. *7c* and that of FIG. *7d* may be reversed in the order of execution. Actually, such order of execution is reversed in the example referred to hereinafter.

Squaring the doubled absolute value of amplitude causes such a change in amplitude as indicates with curves A7, A8, B7 and B8 in FIG. *7e*.

As illustrated in FIG. *7f*, moreover, with respect to the data of Quadrants I and II, one's complement is taken, while with respect to the data of Quadrants III and IV, MSB is made "1" to thereby apply coordinate conversion to the curve of FIG. *7e*, whereby a sine wave of one cycle approximated by squared curves A9, A10, B9 is obtained.

The aforementioned principle of waveform composition using square operation and coordinate transformation is effectively utilized in the tone wave composition to be described.

Figure 8:
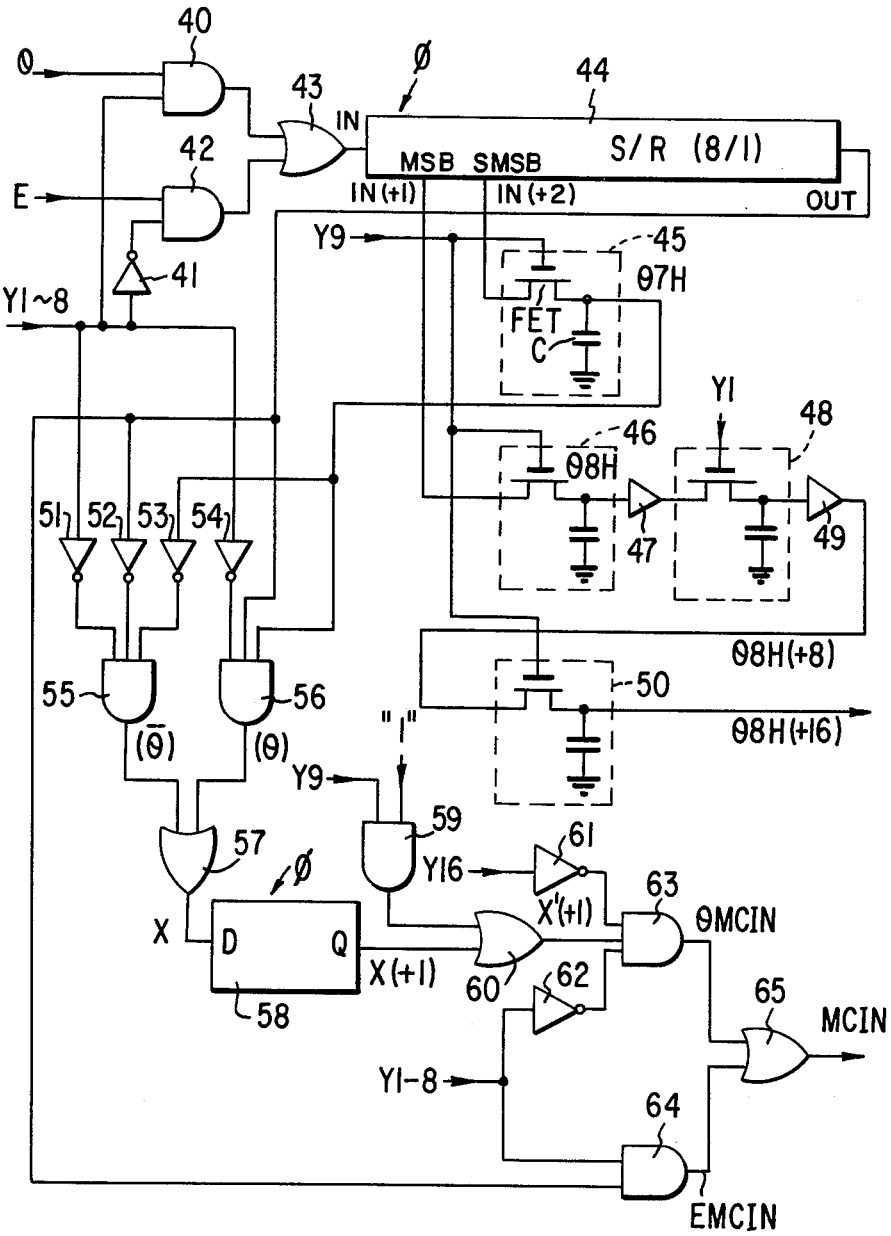
FIG. 8 is a logic diagram showing an input circuit in digital tone composing means according to an embodiment of the present invention.
Figure 9:
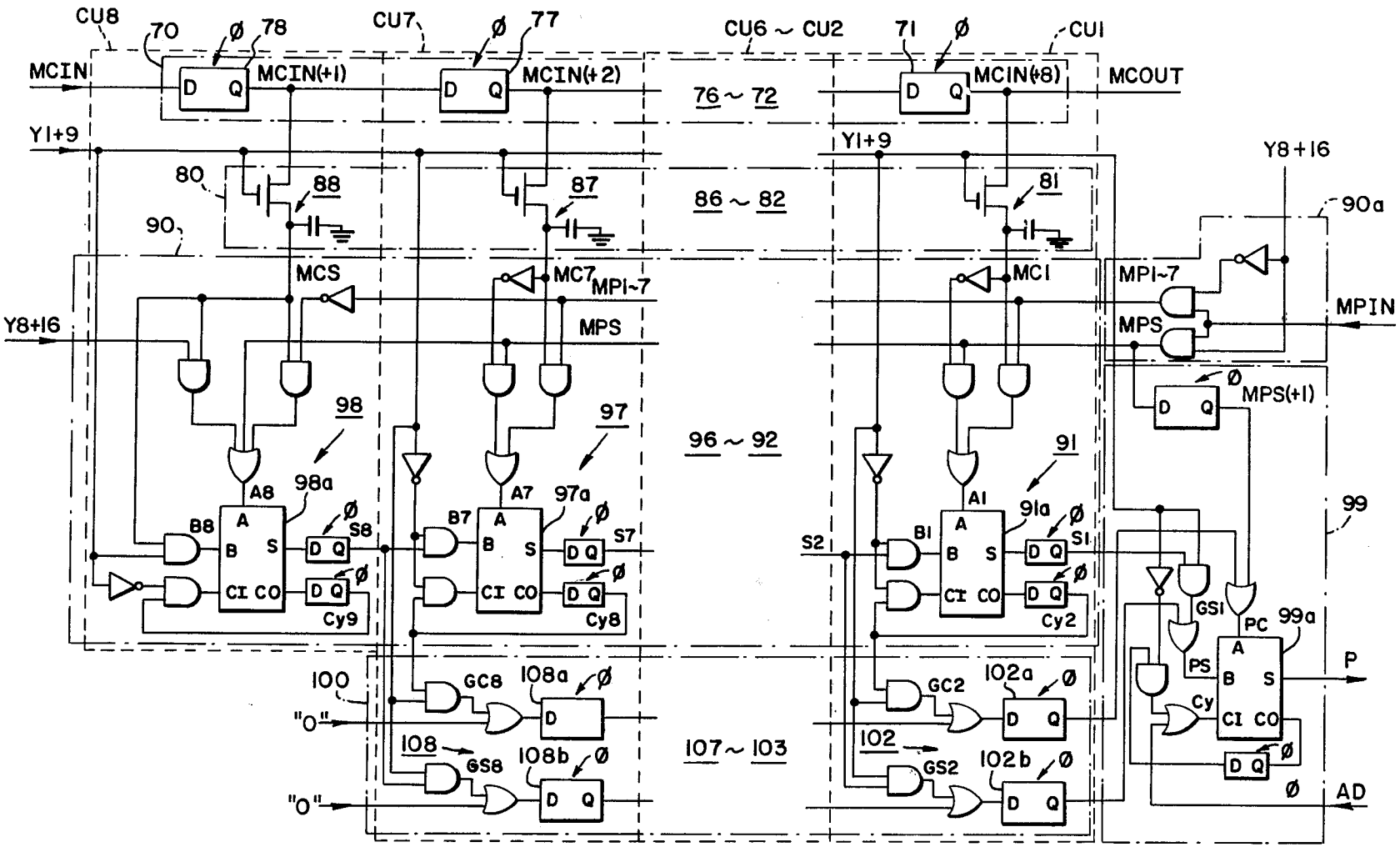
FIG. 9 is a logic diagram showing a serial multiplication circuit in the tone composing means.
Figure 10:
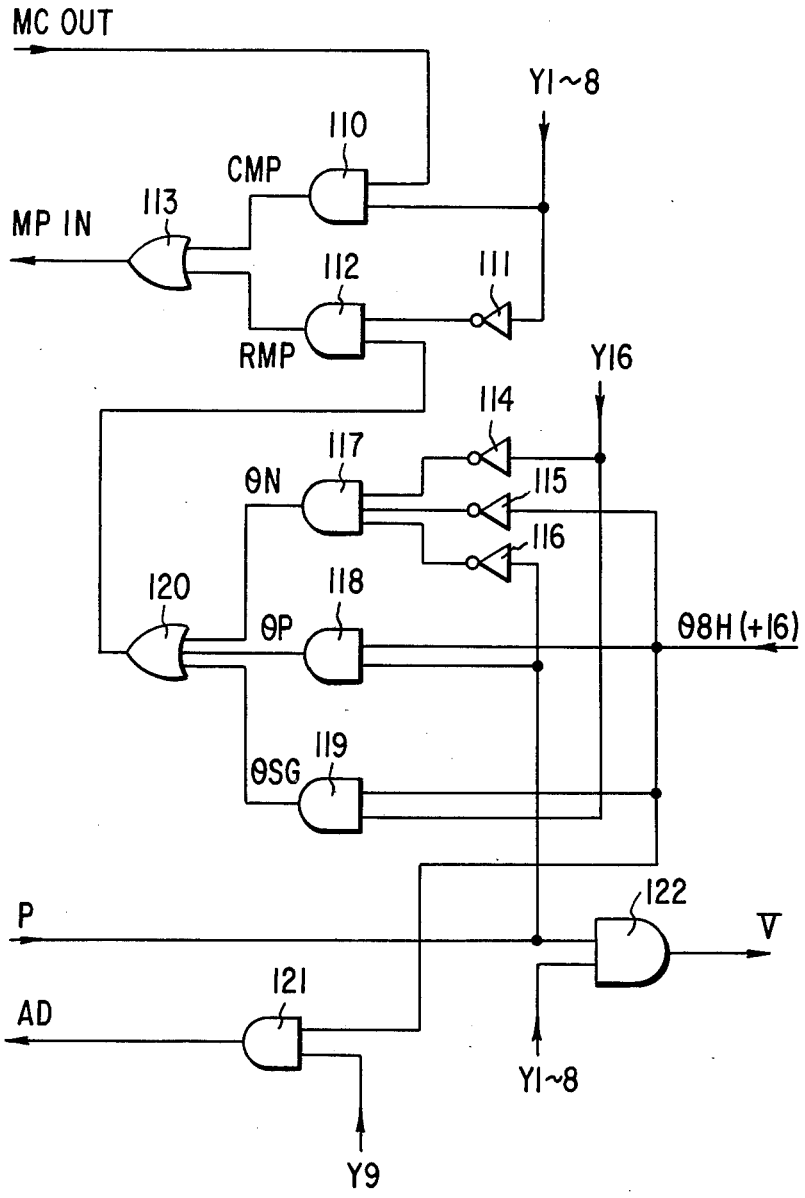
FIG. 10 is a logic diagram showing an output circuit in the tone composing means.
Figure 12A:
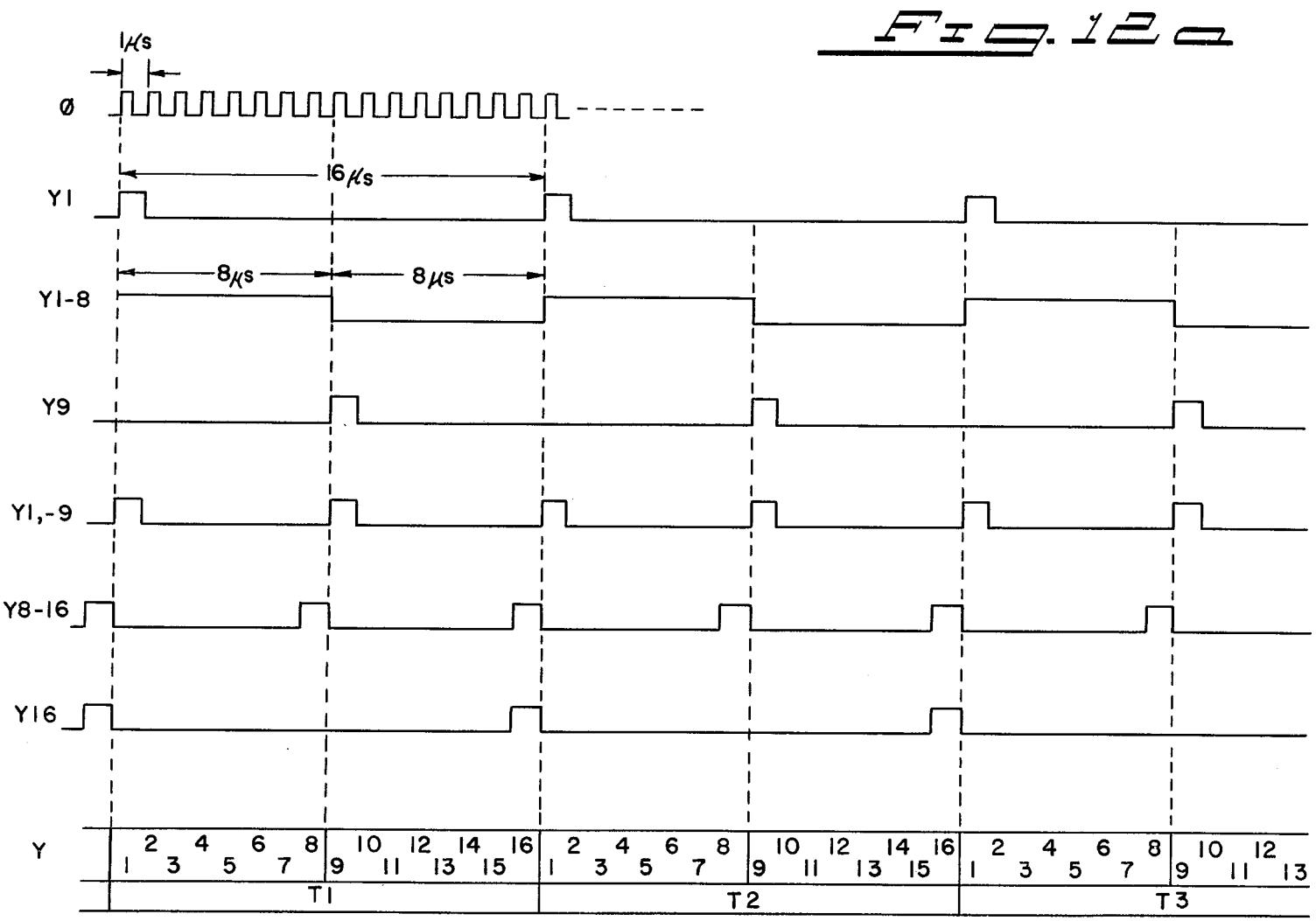
FIGS. 12*a* through 12*h* are time charts for explaining the operation of the circuits shown in FIGS. 8 through 10.
Figure 12:
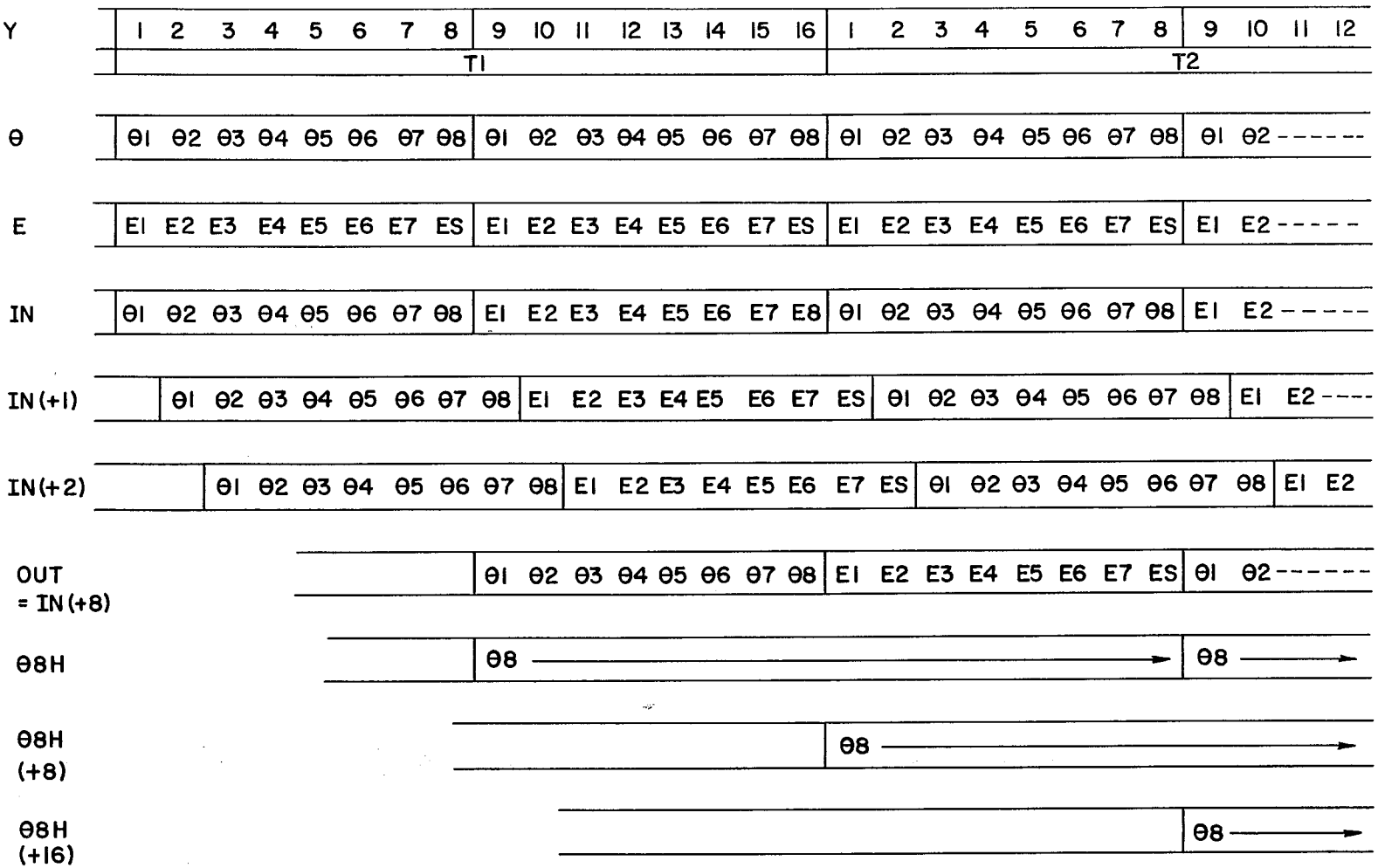
Figure 12:
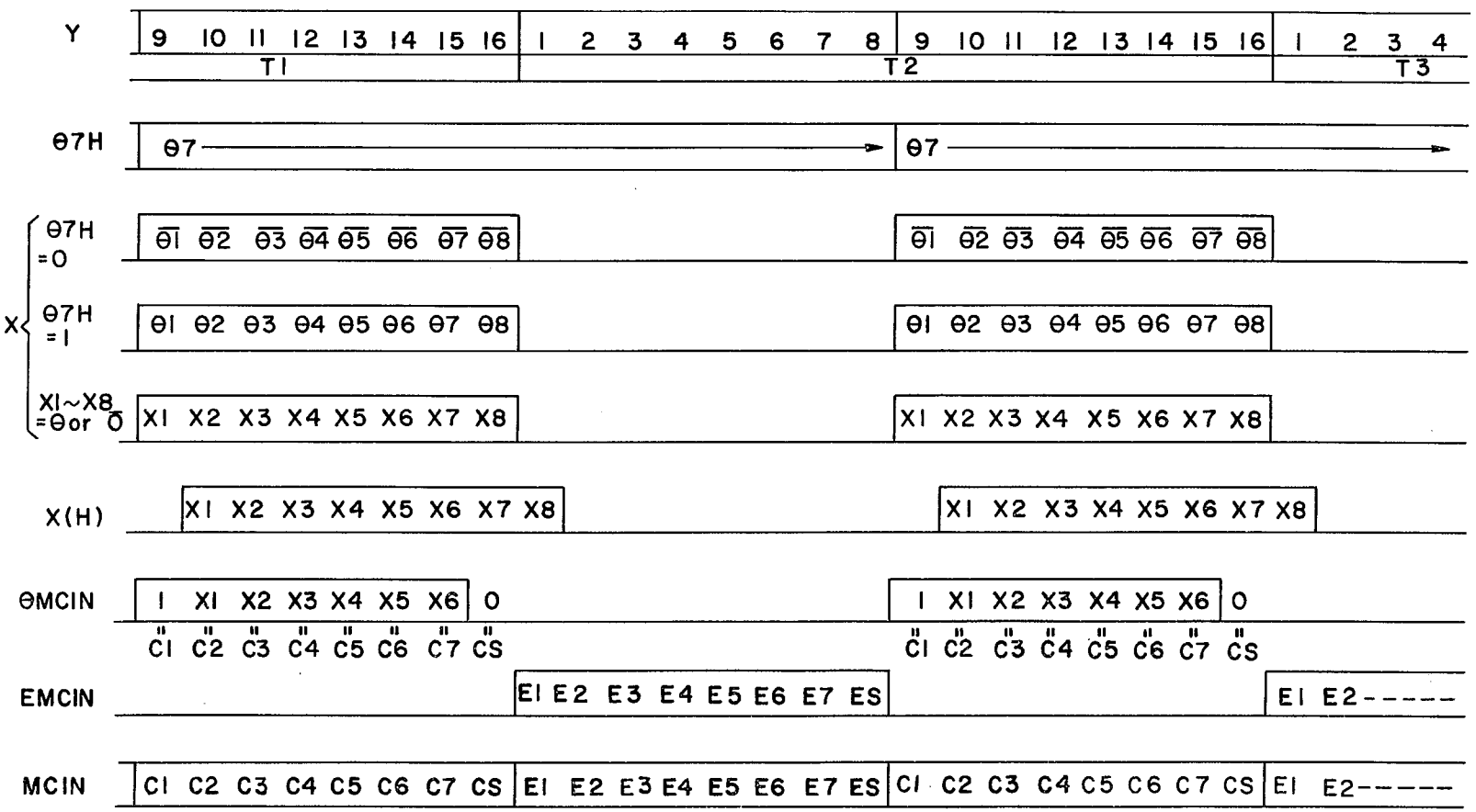

FIGS. 8, 9 and 10 show the details of the tone wave composing means 14. The tone wave composing means 14 is provided as its main components with an input circuit, a serial multiplication circuit and an output circuit. These circuits are illustrated in FIGS. 8, 9 and 10 respectively. All these circuits are designed so as to deal with data of two's complement representation, The clock pulses used in these circuits are as shown in FIG. 12*a* and will be described more in detail hereinafter.

The input circuit shown in FIG. 8 receives a bit-serial digital phase progress input $\theta$ and a bit-serial digital envelope input E and applies to the former the predetermined operation of coordinate conversion and absolute value extraction. Thereafter is combines both inputs alternately serialwise and transmits the combined input as a serial multiplicand input (MCIN) to the serial multiplication circuit of the following stage. AND gates 40 and 42 receive phase input $\theta$ and envelope input E reqpectively at tone input terminals thereof. The gate 40 directly receives clock pulse Y1-8 at the other input terminal thereof, and the gate 42 receives Y1-8 at the other input terminal through inverter 41, so that the inputs $\theta$ and E are passed alternately. OR gate 43, which receives the outputs of AND gates 40 and 42, transmits a serial input, IN, as an alternate combination of the inputs $\theta$ and E to a delaying 8-stage/1-bit shift register 44 which is timed with clock pulse $\phi$. A serial output, OUT, from the shift register 44 is fed to one input terminal of AND gate 56. Parallelwise, moreover, the serial output OUT is fed to one input terminal of AND gate 55 via inverter 52 and further it is parallelwise fed to one input terminal of AND gate 64. The clock pulse Y1-8 is fed to other one input terminals of 3-input AND gates 55 and 56 via inverters 51 and 54 respectively. To the remaining input terminals of AND gates 55 and 56 is fed a control input θ7H via inverter 53 on the side of the gate 55 and without the inverter on the gate 56 side.

The control input θ7H is generated by a latching circuit 45 which sample and holds the second most significant bit (SMSB) of a 2-bit time delayed serial input, IN (+2), at a timing of clock pulse Y9. The latching circuit 45, like latching circuits 46, 48 and 50 as will be described hereinafter, is provided with a sampling field-effect transistor (FET) and a data storing capacitor, C, connected between its source and ground.

The outputs of AND gates 55 and 56 are OR-operated by OR gate 57 and the resulting OR output, X, is fed to the input of a 1-bit time delay flip-flop which is timed with clock pulse $\phi$. OR gate 60 receives at tone input terminal thereof a 1-bit time delayed output, X(+1), from the flip-flop 58. To the other terminal of OR gate 60 is fed the output of AND gate 59 which introduces "1" at a timing of clock pulse Y9. The OR gate 60 transmits a delay output of the least significant bit plus "1", X'(+1), to one input terminal of a 3-input AND gate 63. To the other two input terminals of AND gate 63 are connected inverters 61 and 62 which receive clock pulses Y16 and Y1-8 respectively. The output of AND gate 63, θMCIN, and that of AND gate 64, EMCIN, are connected to the input terminals of a 2-input OR gate 65, which generates a multiplicand input, MCIN, for the serial multiplication circuit of the following stage. Since clock pulse Y1-8 is applied to AND gate 63 via inverter 62 and to AND gate 64 without passing through an inverter, the multiplicand input, MCIN, is obtained as an alternate serial continuity of the phase multiplicand input, θMCIN, and the envelope multiplicand, EMCIN.

Referring to a series of circuits for extracting the phase progress input θ from the serial output, OUT, of shift register 44 and applying coordinate conversion thereto, the phase input θ is extracted at AND gates 55 and 56 at an inversional timing of Y1-8 from the serial output, OUT. If the control input θ7H is "1" (that is, when the SMSB of the phase progress input θ is equal to 1, and this means that the input data relates to Quadrants II and IV), an 8-bit phase progress input θ is put out as the OR output, X via AND gate 56. On the other hand, if the control input θ7H is "0" (that is, when the SMSB of the phase progress input θ is equal to 0, and this means that the input data relates to Quadrants I and III), an 8-bit phase progress input θ which has been inverted by the inverter 52 is put out as the OR output, X, via AND gate 55. This inverted phase progress output $\overline{\theta}$, in other words, results from taking the one's complement on the data related to Quadrants I and III. Thus, the OR output, X, consists of the data of Quadrants II and IV subjected to no transformation and the data of Quadrants I and III subjected to a one's complement transformation. Such a process for forming the OR output, X, corresponds to the process of FIG. 7*b*. The OR output, X, is then converted to a 1-bit time delayed output, X(+1), at the flip-flop for shifter 58. The process for forming this output, X(+1), corresponds to the process already explained in connection with FIG. 7*d*. The output X(+1) is equivalent to a double of the input X. After a "1" has been added to LSB at the OR gate 60, its SMSB is masked at AND gate 63 with the clock pulse Y16 from the inverter 61 at an inversional timing of Y1-8. Then the MSB of the shifted output X(+1) is blocked by Y1-8 and its SMSB is masked by Y16, so that, after passing through AND gate 63, there is only the absolute value data of LSB plus "1". Such a process for forming absolute value data corresponds to the process already explained in connection with FIG. 7*c*. Then, the phase multiplicand, θMCIN, consists of data indicating the absolute value of amplitude at every phase. The reason why the LSB of absolute value data has been set to "1" is that it is intended to increase the degree of approximation to a sine wave of the curves obtained. The multiplicand input, MCIN, is applied to the serial multiplication circuit of the following stage as an alternate serial combination of the phase multiplicand input, θMCIN, consisting of such absolute value indicating data, and the envelope multiplicand input, EMCIN, extracted at AND gate 64.

Before giving an explanation of the serial multiplication circuit, a brief reference is made below to the formation of another control input, θ8H(+16), as shown in FIG. 8. The control input θ8H(+16) is used for controlling the feedback timing of product output, P, in the circuit of FIG. 10. Product output P is a 16-bit time delay of output θ8H, the output θ8H having been obtained by latching the MSB of the 1-bit delayed serial input, IN(+1), by means of the latching circuit 46 at a timing of clock pulse Y9. The 16-bit time delay is obtained by first obtaining an 8-bit time delayed output, θ8H (+8), by means of a second latching circuit 48 whose input and output sides have buffers 47 and 49 respectively and which is controlled by clock pulse Y1, and thereafter passing such output through a third latching circuit 50 which is controlled with clock pulse Y9.

Referring now to FIG. 9, the serial multiplication circuit is explained below in detail. This circuit bit-serialwise receives multiplicand input, MCIN, and multiplier input, MPIN, both of two's complement representation and applies the predetermined multiplication processing, and then it bit-serialwise outputs a product, P, in terms of a two's complement representation. The serial multiplication circuit comprises a serial-parallel converting shift register 70, latching circuit 80, partial product · partial · sum partial carry arithmetic circuit 90, multiplier input circuit 90*a*, addition output circuit 99 and effective digit storing circuit 100. CU1 through CU8 indicate circuit units, and to the portion of CU2 through CU6 are connected five circuit units similar to CU1 or CU7.

The serial-parallel converting, delaying shift register 70, which receives the multiplicand input, MCIN, successively from its least significant bit and which on the one hand outputs bit-parallelwise and on the other bit-serialwise, comprises plural flip-flops 71, 72, . . . 78 of cascade connection. The flip-flops 71 through 78 are each timed with a clock pulse so that a 1-bit time delay is given to the data fed to its input D and then an output is produced at its output Q. The outputs, MCIN(+1), MCIN(+2), . . . , MCIN(+8), having intervals of 1-bit time each form bit-parallel multiplicand inputs, which are sample held by a latching circuit 80. The latching circuit 80 is composed of latching units 81, 82, . . . , 88, each latching unit comprising a combination of such sampling field-effect transistor (FET) and data storing capacitor (C) as having been referred to hereinbefore. The sample hold outputs, that is, the latch outputs, are indicated as MCl, MC2, . . . , MCS for each bit, MC1 being the least significant bis (LSB) and MCS being the most significant bis (MST) and sign bit.

Multiplier input, MPIN, is fed to a multiplier input circuit 90*a* successively from less significant bits. It is divided into the most significant sign bit, MPS, and lower bits, MP1–7, according to the indication of clock pulse Y8+16 and then applied to an arithmetic circuit 90. The input circuit 90*a*, as shown, includes two AND gates and one inverter. To one input terminal of these AND gates is fed the multiplier input, MPIN. The clock pulse Y8+16 is applied to the other input terminal of one AND gate through an inverter and to the other input terminal of the AND gate directly without passing through an inverter. From one AND gate are outputted multiplier bits, MP1–7, and from the other AND gate is outputted multiplier sign bit, MPS. The partial product partial sum partial carry arithmetic circuit 90 on the one hand receives parallel multiplicand inputs (latch outputs) MC1–MC7 and MCS, and on the other receives multiplier inputs MP1–7 and MPS, and generates partial sum outputs S1, S2, . . . , S8 and partial carry outputs Cy2, . . . , Cy9. It includes eight arithmetic units 91, 92, . . . , 98 equal to the number of the desired effective digits. These arithmetic units have, as the main component, the respective full adders 91*a*, 92*a*, . . . , 98*a*. To one inputs A of these full adders are fed partial product inputs A1, A2, . . . , A8 respectively. To an input B of the full adder 98*a* for the most significant digit is fed the multiplicand sign bit, MCS, as a partial product at a timing of clock pulse Y1+9. To inputs B of full adders 91*a* through 97*a* are fed partial sum outputs S2-S8 from the preceding-stage full adders 92*a* through 98*a* as B1–B7 at an inversional timing of clock pulse Y1+9. To a sum output S of each of the full adders 91*a* through 98*a* is connected a flip-flop which is timed with clock $\phi$ and gives a 1-bit time delay between input D and output Q. Also between carry output, CO, and carry input, CI, is given a 1-bit time delay by a similar delaying flip-flop. The partial product inputs A1–A7 are given as a logical sum of MC1, MC2, . . . , MC7 which have been AND-operated by MP1–7 respectively and $\overline{MC1}$, $\overline{MC2}$, $\overline{MC7}$ which have been AND-operated by MPS. The partial product input A8 is given as a logical sum of MCS which has been AND-operated by clock pulse Y8+16, MCS which has been AND-operated by MP1–7, and MCS.

An addition output circuit 99 is for adding the data from the arithmetic circuit 90, the read data from an effective digit storing circuit 100 as will be described hereinafter, and addition input AD, and forming a serial product output P. As its main component, it includes a full adder 99*a*. To one input A of the full adder 99*a* is applied a partial carry input PC consisting of a logical sum of output MPS(+1) as a partial product with MPS delayed by a 1-bit time delaying flip-flop, and the partial carry output from the effective digit storing circuit 100. To the other input B is applied a partial sum input PS consisting of a logical sum of a partial sum output GS1 which results from AND-operating the least significant digit data in the effective digits, S1, and clock pulse Y1+9, and the partial sum output from the effective digit storing circuit 100. Between the carry ourpur CO and carry input CI of the full adder 99*a* is connected a 1-bit time delaying flip-flop. The delayed data from this flip-flop is extracted at an inversional timing of clock pulse Y1+9 and fed to the carry input CI, in the same manner as in the foregoing arithmetic units. In the carry input CI is disposed an OR gate, to which is fed a carry data C*y* consisting of a logical sum of AND output of the foregoing Y1+9 and delayed data, and an addition input AD as will be described hereinafter. The product output P is obtained from the sum output S of full adder 99*a*.

The effective digit storing circuit 100 reads in bit-parallelwise and in a simultaneous manner the data corresponding to the effective digits of the partial sum and partial carry which have been operated on by the arithmetic circuit 90, and stores the data temporarily. Such data is read out bit-serialwise and fed to the foregoing addition output circuit 99. The store circuit 100 comprises seven (less by one than the number of effective digits) storing units 102, 103, . . . , 108, which are provided with partial carry storing flip-flops 102*a*–108*a* being timed with clock pulse $\phi$, and also with partial sum storing flip-flops 102*b*, 103*b*, . . . , 108*b*, respectively, the flip-flops 102*B*–108*b* being timed with the same clock $\phi$. To the input D of the flip-flop 102*a* is fed a logical sum of GC2 obtained by AND-operating clock pulse Y1+9 and partial carry C*y*2, and the output of the corresponding flip-flop (not shown) in the preceding-stage storing unit 103. To the input D of the flip-flop 102*b* is fed a logical sum of GS2 obtained by AND-operating the partial sum output S2 and clock pulse Y1+9, and the output of the corresponding flip-flop in the preceding-stage storing unit 103. The storing units 103–108 are also of such a configuration. Provided, however, that in the case of storing unit 108 for the mose significant digit, there is no preceding-stage storing unit and that therefore "0" is fed to the other input terminals of the OR gates than those to which GC8 and GS 8 are applied. This point is a special configuration. At the time when the data of the desired effective digits has become complete in the arithmetic units 91–98 of the arithmetic circuit 90 and in synchronism with the time when the least significant digit data (partial sum) S1 in such effective digits is transferred to the addition output circuit 99, the partial sum partial carry data is transmitted simultaneously bit-parallelwise from the corresponding arithmetic units to store units 102–108, and the storing circuit 100 reads out such data bit-serialwise in order from the least significant bit and transfers it to the addition output circuit 99.

When the arithmetic circuit 90 sends data to the storing circuit 100, all of its interior data is cleared.

The output circuit, another component of the tone composing means is shown in FIG. 10. In the circuit of FIG. 10, AND gate 122 receives clock pulse Y1–8 at one input terminal thereof, and to the other input terminal thereof is fed the product output P. From the gate 122 is taken out a composite tone signal V. The addition input AD, which is connected to the carry input CI of full adder 99*a* via OR gate, is generated by a 2-input AND gate 121 which receives the control input $\theta$8H(+16) as referred to in connection with FIG. 8, and also receives clock pulse Y9. The object of this addition input is to add "1" to the LSB of the date of Quadrants III and IV at the time of forming product output to thereby increase the degree of approximation of a sine wave by squared curves.

The serial multiplicand output MCOUT (=MCIN(+8)) from the shift register 70 shown in FIG. 8 is applied to one input terminal of AND gate 110 which at the other input terminal thereof receives clock pulse Y1–8. The output CMP of AND gate 110 is applied to OR gate 113 together with the output RMP of AND gate 112 to one input terminal of which is applied clock pulse Y1-8 via inverter 111. The OR gate 113 transmits to the foregoing multiplier input circuit 90*a* the multiplicand input MCIN as a serial combination of the outputs CMP and RMP which are produced at an alternate inversional and non-inversional timing of clock pulse Y1-8. Therefore, in the foregoing serial multiplication circuit, a multiplication in which multiplicand and multiplier are the same, that is, a square operation (which corresponds to the processing of FIG. 7*e*), is done. As already mentioned, it is one feature of the present invention that a square operation and a coordinate conversion are utilized to compose an approximated sine wave connected with the tone frequency. Another freature of the present invention is that the approximate sine wave obtained is multiplied by an envelope input and particularly such multiplication is carried out using the hardware (serial multiplication circuit) which has been used in the square operation. In order to execute such multiplication, in the circuit of FIG. 10, the product output P and more particularly the squared output is fedback as a multiplier input to the input side of the serial multiplication circuit. In such feedback, means for coordinate conversion (which is for executing the processing corresponding to that of FIG. 7*f*) is provided in the feedback path, whereby sine wave data approximated by squared curves is formed. To be more specific, the product output P is on the one hand applied to one input terminal of a 3-input AND gate 117 via inverter 116, and on the other applied to one input terminal of a 2-input AND gate 118 directly without passing through an inverter. The control input $\theta$8H(+16), as already mentioned, results from delaying the MSB of phase input $\theta$ by a 16-bit time, and it is "1" with respect to the data of Quadrants III and IV and is "0" with respect to the data of Quadrants I and II. The control input $\theta$8H(+16) is applied to AND gate 117 via inverter 115 and also to AND gate 119 without passing through an inverter. Likewise, the clock pulse Y16 is applied to AND gate 117 via inverter 114 and also to AND gate 119 without passing through an inverter. The outputs $\theta$N, $\theta$P and $\theta$GS of AND gates 117, 118 and 119 are fed to the input terminals of a 3-input OR gate 120. The output of the OR gate 120 is extracted as an approximate sine wave feedback output RMP at an inversional timing of clock pulse Y1-8 in the foregoing AND gate 112. The output RMP assumes the following state: for $\theta$8H(+16) = "0", $\theta N = \overline{P}$ at an inversional timing of clock pulse Y16 and, for $\theta$8H(+16) = "1", $\theta$P = P, and $\theta$SG = "1" added to the MSB of $\theta$P at an inversional timing of Y16. Then the output of OR gate 113, that is, the multiplier input, becomes an alternate serial combination of CMP = MCOUT and RMP = $\theta$N or $\theta$P + $\theta$SG according to the timing of Y1-8.

Figure 11B:
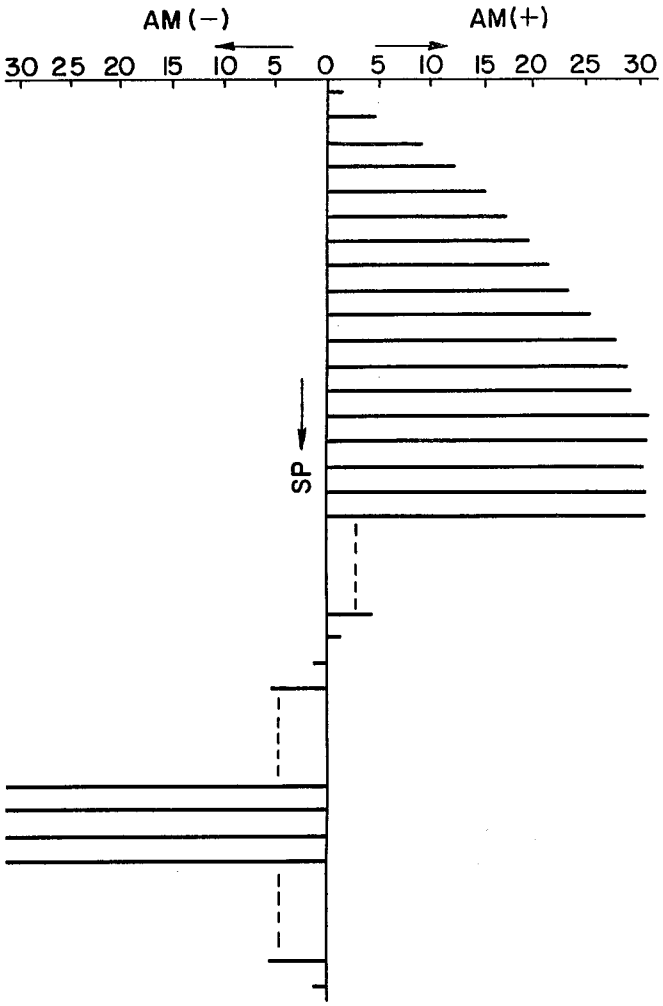
FIGS. 11*a* and 11*b* are a binary signal table and a digital waveform diagram respectively showing an example of waveform composition following the principle of the present invention.
Figure 11A:
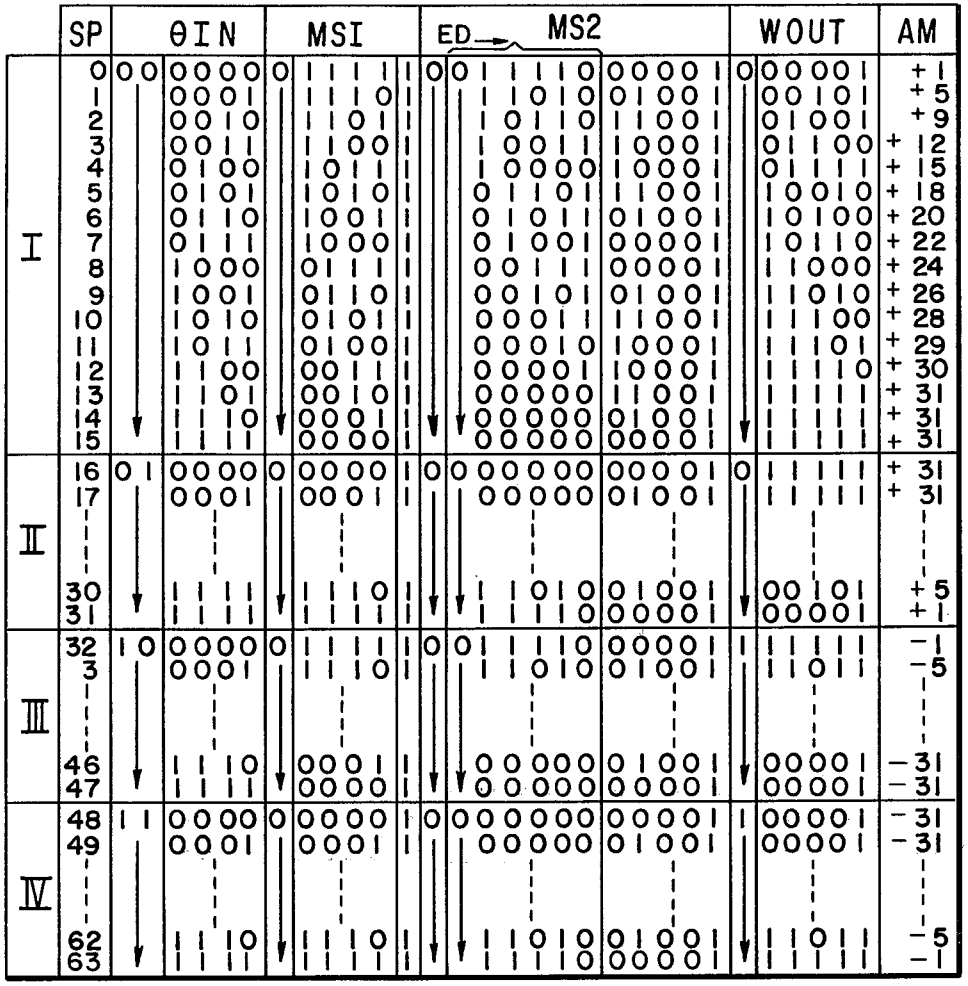

Before explaining as a whole an example of the operation of the tone composing means, the operation for composing an approximate sine wave is explained below with reference to FIGS. 11*a* and 11*b*. The tone composing system hereinbefore described has been designed so as to deal with 8-bit data in terms of a two's complement representation. But in the example about to be described, reference is made, for ease of explanation, to the composition of an approximate sine wave by the logical operation of 6-bit data in terms of two's complement representation. As the number of data bits increases, the quantizing noise decreases and the degree of approximation increases, but there is no special change in the principle itself of the approximate sine wave composition. In FIG. 11*a*, the numerals I, II, III and IV represent the quadrant numbers already explained in connection with FIGS. 7*a* through 7*f*, and SP is a sample point number. In this example, it is intended to compose the respective amplitudes, AM, at 64 sample points. A digital phase input $\theta$IN consists of a 6-bit binary code of a two's complement representation and it corresponds to the foregoing phase input $\theta$. The more significant two bits of the phase input $\theta$IN is "00" in Quadrant I, "01" in Quadrant II, "10" in Quadrant III, and "11" in Quadrant IV.

Figure 7A:
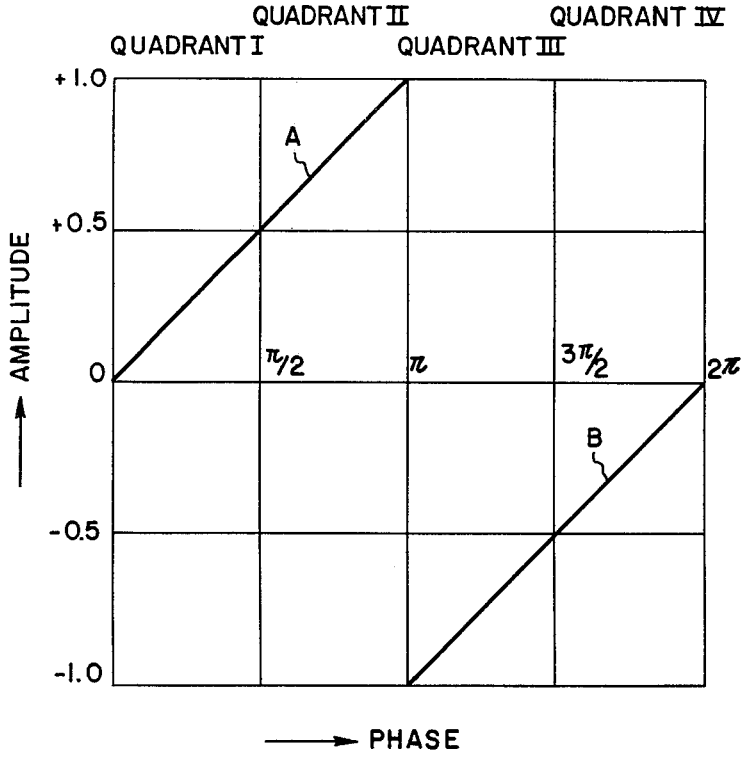
FIGS. 7*a* through 7*f* are graphs showing an example of the method for composing an approximate sine wave using a coordinate conversion and a squaring operation.
Figure 7B:
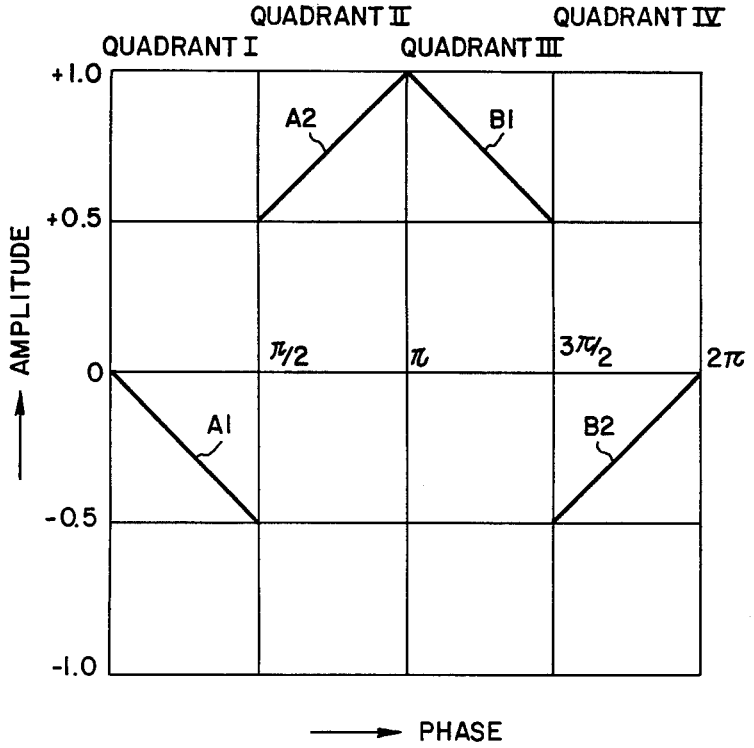
Figure 7C:
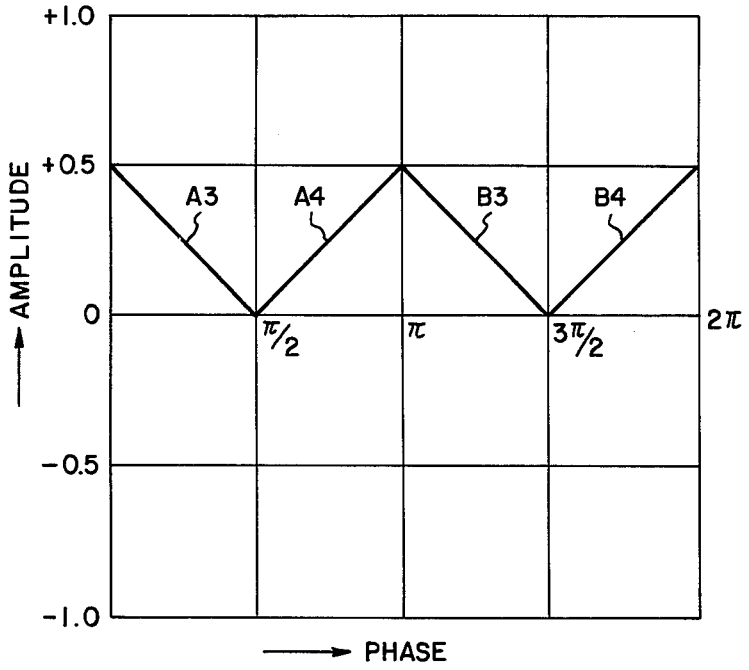
Figure 7D:
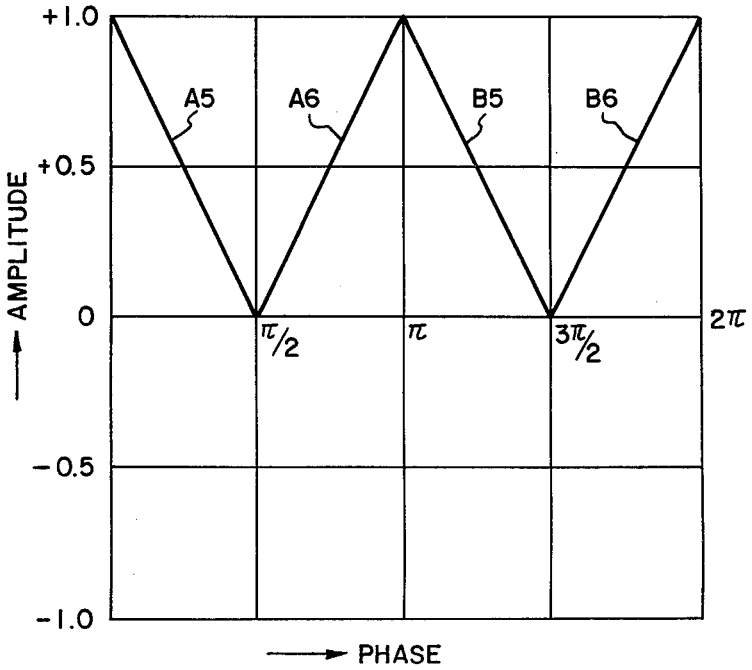
Figure 7E:
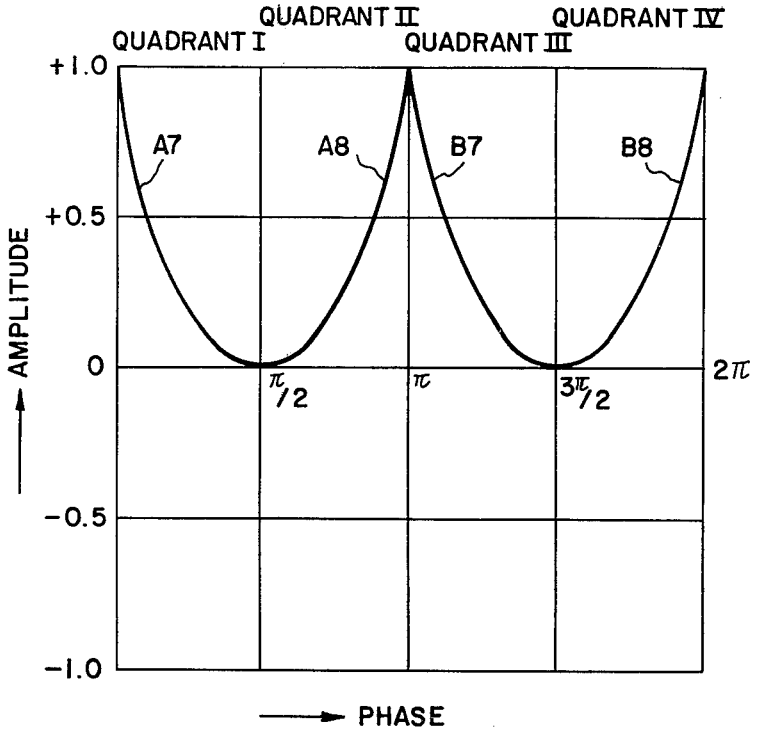
Figure 7F:
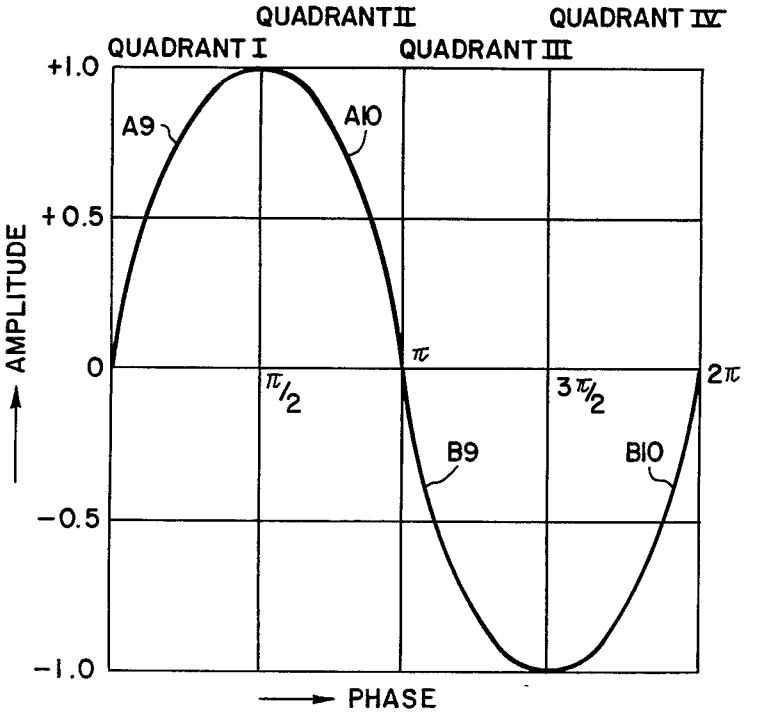

The phase input $\theta$IN as shown in FIG. 11*a* should analogwise be represented as in FIG. 7*a*. In such an input circuit as shown in FIG. 8, a one's complement is taken on the data (least significant 4 bits) of Quadrants I and III. This process corresponds to the process explained in connection with FIG. 7*b*. This data is doubled in all the quadrants (this processing corresponds to that of FIG. 7*d*, and the data after processing corresponds to the X(+1) of FIG. 8), and thereafter "1" is added to LSB. What is obtained as a result of undergoing the processings so far given, is a middle signal MS1. Then, an absolute value extracting operation as in FIG. 7*c* is applied for removing MSB from the middle signal MS1. The 5-bit absolute value data (which corresponds to the X'(+1) in FIG. 8) is then fed not only as multiplicand input, MCIN, but also as multiplier input, MPIN, to a serial multiplication circuit which is similar to that shown in FIG. 9, and thus it is squared. This process corresponds to that explained in connection with FIG. 7*e*. The middle signal obtained as a result of the square operation is such as that indicated with MS2 in FIG. 11*a*. From this middle signal MS2, only the 6-bit data of more significant digits, ED, is extracted. Such an extraction of effective digit data is automatically carried out if the serial multiplicationi circuit shown in FIG. 9 has been configured for 6-bit data use. In such an output process of effective digit data, a "1" is added to the LSB of the effective digit data of Quadrants III and IV, as already referred to in connection with the addition input AD in FIGS. 9 and 10. The squared effective digit data with a "1" added to the LSB with respect to Quadrants III and IV is conducted as a product output to the circuit of FIG. 10, where a one's complement is taken in the data of Quadrants I and II and, with respect to the data of Quadrants III and IV, a "1" added to the MSB thereof. This process corresponds to that explained in connection with FIG. 7*f*. As a result, such a waveform output, WOUT, as shown in FIG. 11*a* can be obtained. In the circuit of FIG. 10, this waveform output corresponds to the output of OR gate 120. The waveform output WOUT represented in terms of decimal digits is the amplitude AM. In FIG. 11*b*, the change of the amplitude AM is shown in relation to the sample point SP. FIG. 11*b* shows all amplitudes at each sample points constituting the waveform up to $\pi/2$ in terms of phase (corresponding to Quadrant I). But with respect to Quadrants II through IV, a part is omitted. From FIG. 11*b* it is easily understood that the waveform output WOUT is a digital output indicating a sine wave approximated by squared curves.

Referring not to FIGS. 12*a* through 12*h*, an explanation is given below of an example of the operation as a whole of the tone composing means already referred to in connection with FIGS. 8 through 10.

FIG. 12*a* exemplifies clock pulses used, in which clock pulse $\phi$ consists of a rectangular pulse train of a 1 $\mu$S period. This one period corresponds to the period of 1-bit time. The clock Pulse Y1 consists of a rectangular pulse train of 1-bit time width having a period of 16 μS. Y1–8 consists of a rectangular pulse train of 8 μS (8-bit time width) having a period of 8 μS. Y9 is a pulse train with Y1 delayed by 9-bit time. Y1+9 and Y8+16 each consist of a rectangular pulse train of 1-bit time width having an 8 μS period, but the latter leads the former by 1-bit time. Y16 consists of a similar pulse train to that of Y1, but it leads Y1 by 1-bit time. Y is a diagrammatical representation of the clock timing divided at every 16-bit time into periods T1, T2, T3, . . . so that the timing relation of the aforementioned clock pulses may be easily understood. Each period consists of the first half of 8-bit time and the latter half of 8-bit time. If each clock is viewed in connection with wuch a time base Y, it is seen that the clock Y1 indicates the 1st bit time, Y1–8 indicates the 1st to 8th bit time, Y9 indicates the 9th bit time, Y1+9 indicates the 1st and 9th bit time, Y8+16 indicates the 8th and 16th bit time, and Y16 indicates the 16th bit time. The time base Y is cited as necessary in FIGS. 12*a* through 12*h*.

Figure 12D:
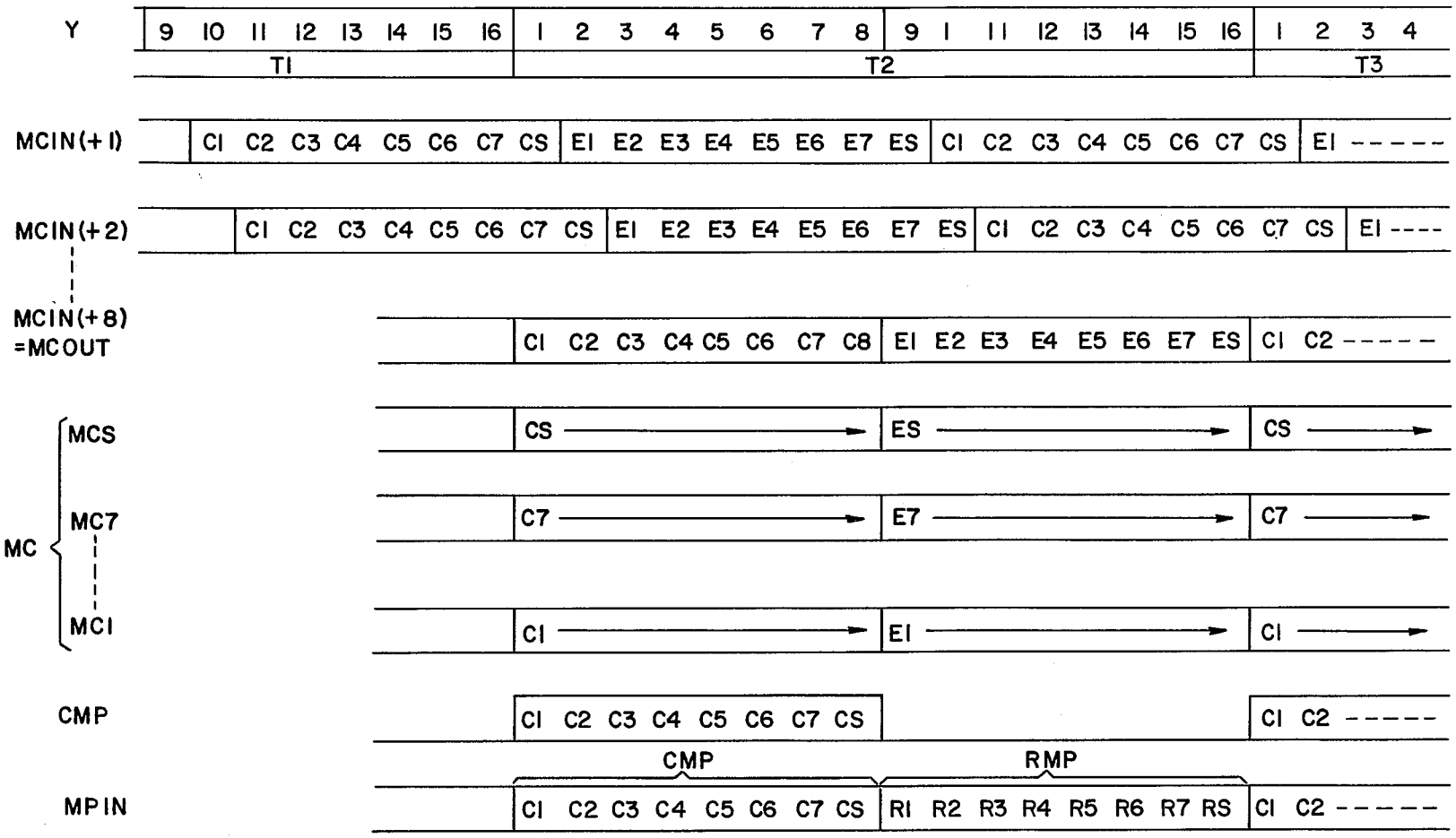
Figure 12B:
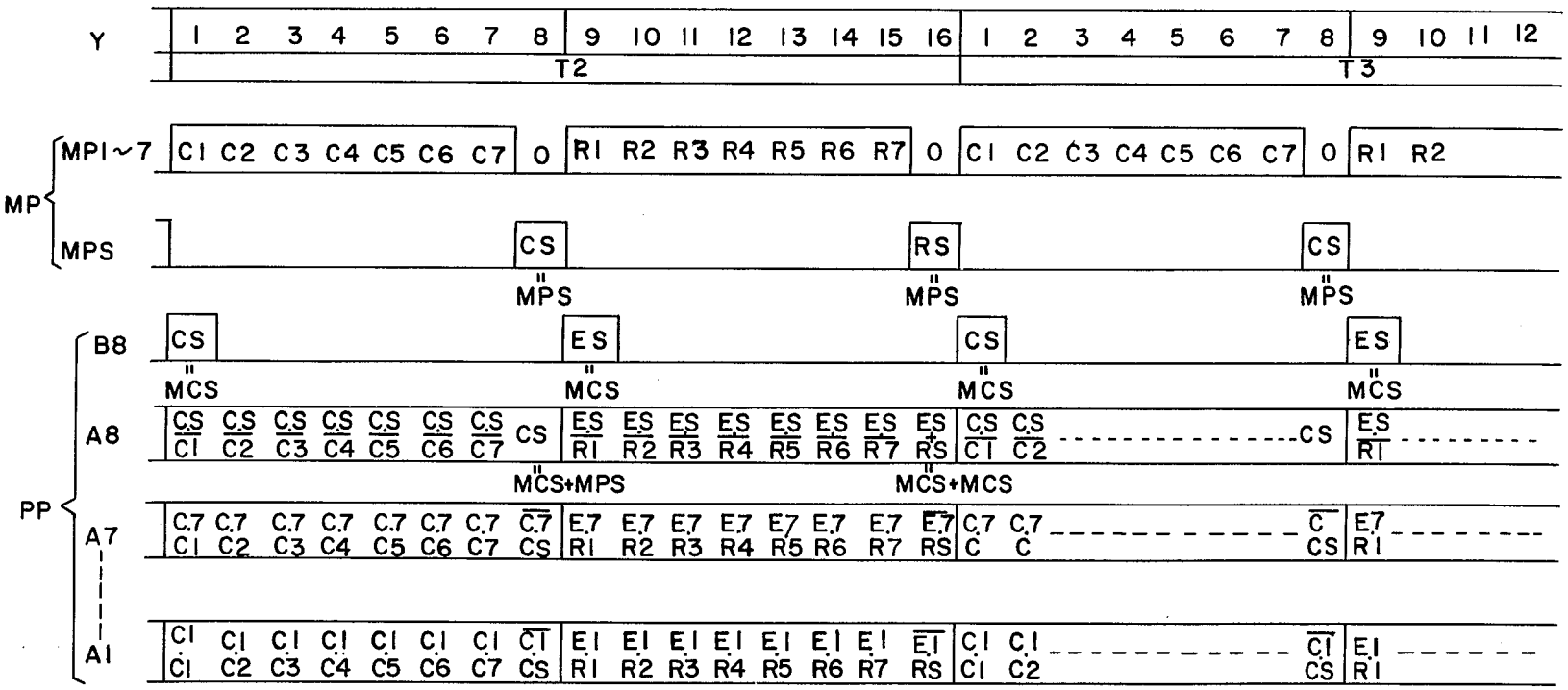

As shown in FIG. 12*b*, the digital phase input θ and the digital envelope input E consist of 8-bit data θ1 to θ8 and E1 to E8 respectively both in terms of a two's complement representation. They are fed to the input circuit of FIG. 8 serially from the first half of the first period T1. The serial input IN, as shown in FIG. 12*b*, is operated so as to include phase data 01 to 08 at the first half of the first period T1 and include envelope data E1 to E8 at the latter half therof. This operation is carried out by the control of clock Y1–8 for the gates 40 and 42. The delayed outputs IN(+1), IN(+2) and OUT(=IN(+8)) from the shift register 44 are in the timing relationship shown. In FIG. 12*b* there are also shown output θ8H produced by sample holding the MSB of the output IN(+1) according to clock Y9, and outputs θ8H(+8) and θ8H(+16) produced by delaying the output by 8-bit time and 16 bit time respectively.

In FIG. 12*c* there is shown output θ7H produced by latching the SMSB of the output IN(+2) by means of the latching circuit 45. The output X of the OR gate 57 is obtained as either θ or $\overline{\theta}$ at the latter half of the first period T1 according to whether θ7H is a "1" or "0" (that is, according to whether the data are of Quadrants II and IV of or Quadrants I and III). The bits of the output X are shown as X1 to X8. The output X(+1) produced by delaying the output X by 1-bit time with the flip-flop 58 becomes X'(+1) after a "1" has been added to its LSB, and the SMSB (=CS) is masked through AND gate 63 to give the phase multiplicand input θMCIN. It is seen that the envelope multiplicand input EMCIN is combined with θMCIN alternately and serially in the circuit including AND gates 63 and 64 and OR gate 65, and becomes the multiplicand input MCIN. According to FIG. 12*c*, it is seen that the time when the phase data OMCIN after being subjected to coordinate conversion first enters the serial multiplication circuit (FIG. 9) as MCIN is at the latter half of the first period T1 and that thereafter the multiplicand input MCIN is fed continuously and alternately with the envelope data E1 to E8.

In FIG. 12*d*, there are shown multiplicand inputs MCIN(+1), MCIN(+2) . . . MCIN(+8) = MCOUT which have been delayed in the shift register 70, and parallel multiplicand bits (latch outputs) MC1 to MC7, and MCS. CMP is an output produced by AND-operating the serial multiplicand output MCOUT with clock pulse Y1–8 in the circuit of FIG. 10. The multiplier input MPIN results from a serial combination by means of the AND gates 110 and 112 and OR gate 113 in FIG. 10 so that it includes data C1 to CS of the output CMP at the first half of the second period T2 and includes data R1 to RS of the output RMP at the latter half thereof. The multiplier bit MP1 to 7 and the multiplier sign bit MPS, which have been divided in the multiplier input circuit 90*a* of FIG. 9, are shown in FIG. 12*e*. PP represents partial product inputs, which are data fed to the inputs A1 to A8 and B8 of the full adders 91*a* to 98*a* in the circuit of FIG. 9. The marks "." and "+", which are used for expressing the contents of the data A1 to A7 and A8, represent AND and OR respectively.

Figure 12F:
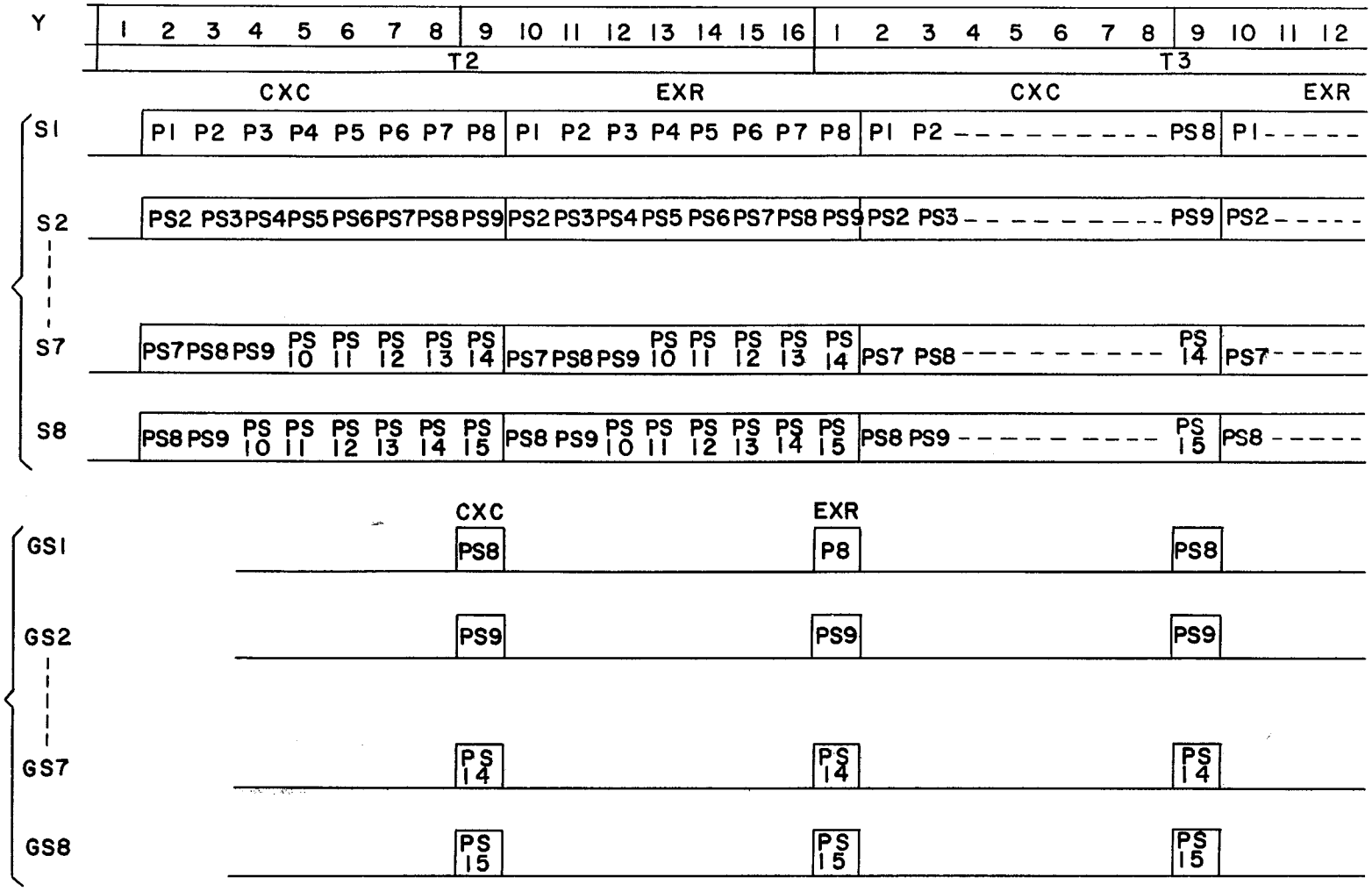
Figure 17:
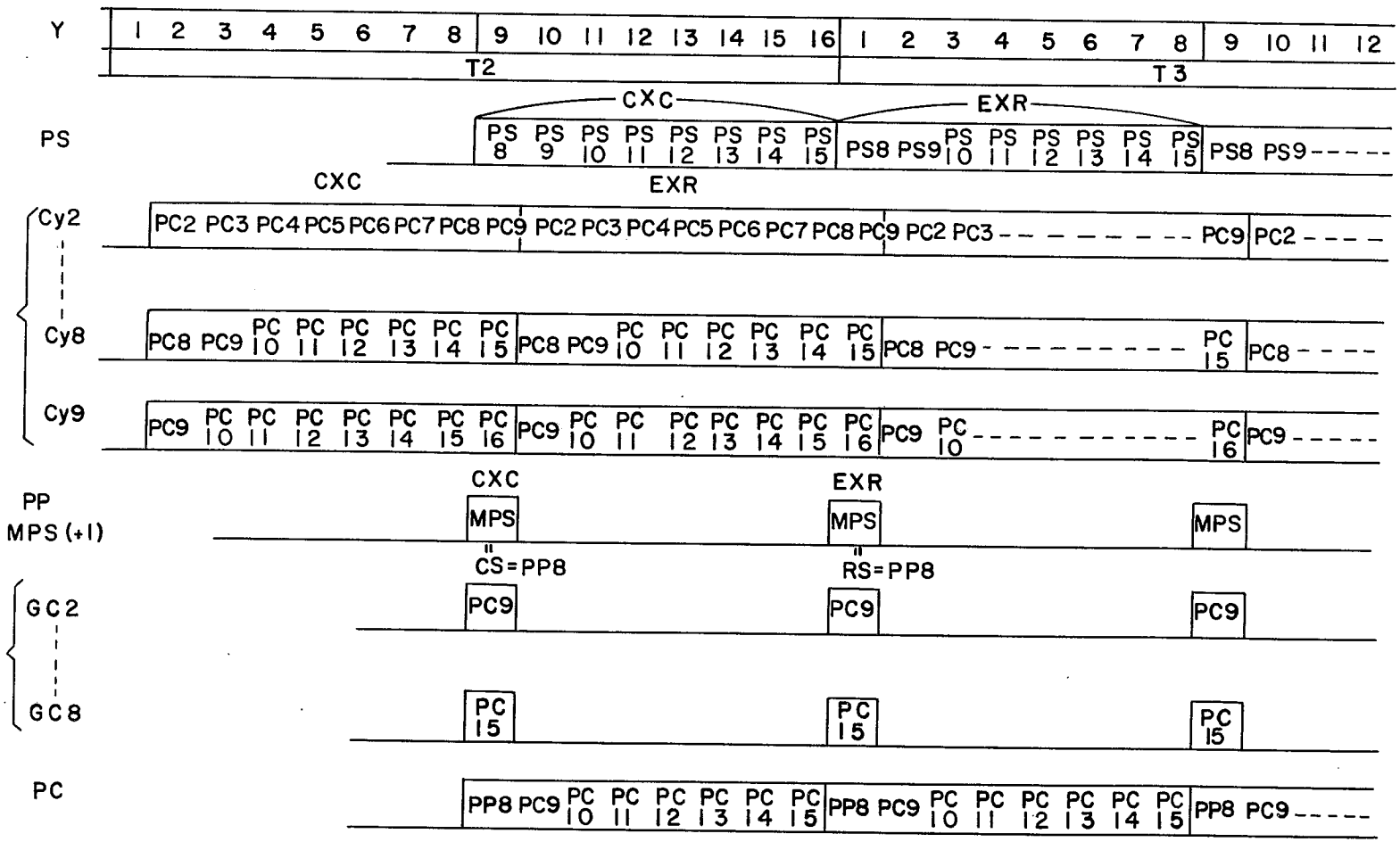
Figure 14:
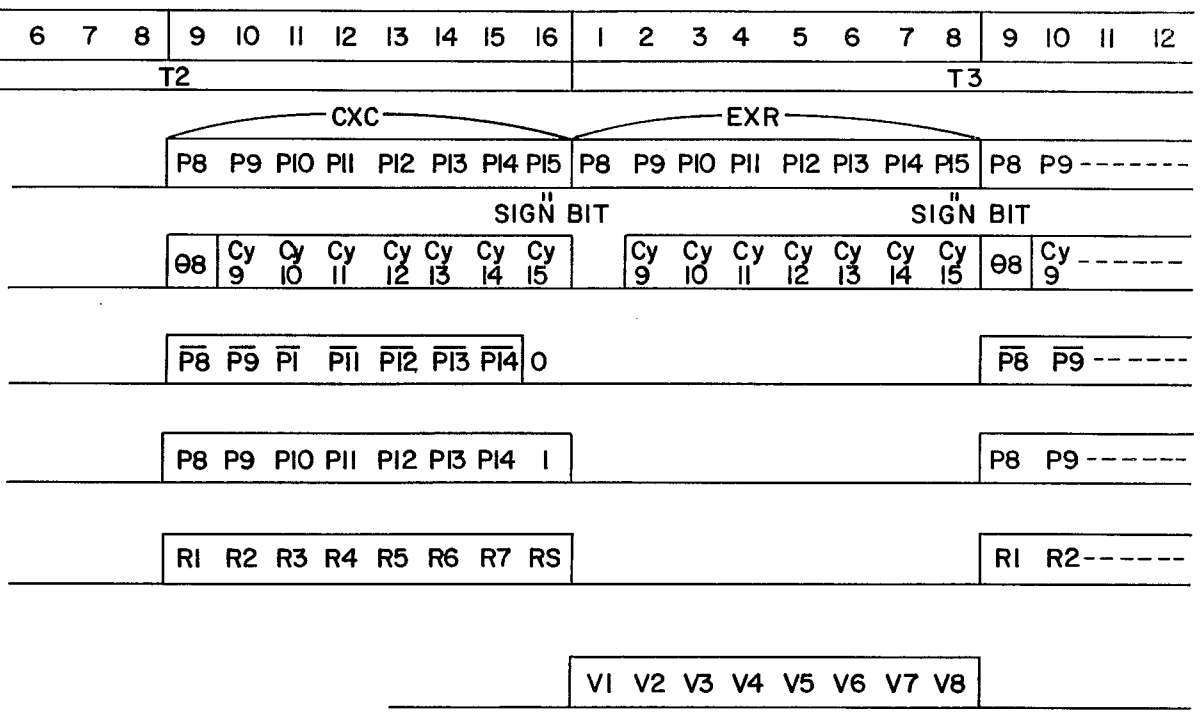
Figure 15:
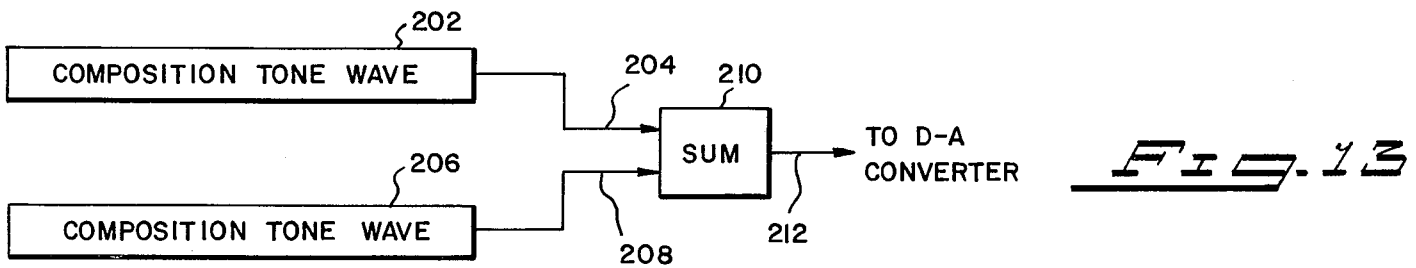

The partial sum outputs S1–S8 which are outputted from the arithmetic units 91 through 98, and the data GS1 to GS8 which have been parallelwise issued so as to be stored as effective digit data in the storing circuit 100, are shown in FIG. 12*f*. It is seen that, in this case, what becomes the effective digit data is the data of PS8 to PS15. In synchronism with the transfer of the LSB of the effective digit data, PS8 and P8, to the addition output circuit 99, a parallel transfer of the most significant digit data of PS9 to PS15 to the storing circuit 100 is conducted and at the same time the interior of each arithmetic unit is cleared. This enables the arithmetic units 91 to 98 to immediately effect operation on the next set of multiplicand-multiplier inputs. As a result, an effective use of hardware is made possible and also the computing speed is improved. According to FIG. 12*f*, it is seen that during the first half of the second period T2, partial sum data is formed on the input CXC, that is, on the square operation for forming the waveform and that at the latter half thereof, partial sum data is formed on the multiplication of the product R of input CXC, and input E.

In FIG. 12*q* there is shown in connection with the time base Y the bit-serial partial sum data PS fed to the input of full adder 99*a*, partial carry data C*y*2 to C*y*9 in the arithmetic units 31 to 38, MPS(+1) produced by delaying the multiplier sign bit as a partial product by 1-bit time, carry data GCS2 to GC8 stored in parallel, and partial carry data PC serially transferred to full adder 99*a*. The product output P which is obtained by feeding the partial sum data PS, partial carry data PC and carry data C*y* into the full adder 99*a* of the addition output circuit 99, is shown in FIG. 12*h*. It is seen that to the LSB of the carry data C*y* is added θ8 (which is a "1" only with respect to Quadrants III and IV) at a timing of Y9. In the circuit of FIG. 10, feedback of the product output P to multiplier input MCIN is made, and the feedback output RMP is controlled so that the bits R1 to RS are equal to θN or θP + θSG.

As shown in FIG. 12*h*, at the first half of the third period T3, a composite digital tone signal V is put out from AND gate 122 which receives clock Y1–8 and product output P. The tone signal V consists of 8-bit data V1 to V8 produced by multiplying the product R of phase input CXC by envelope input E.

The tone signal V is analog-converted, as shown in FIG. 1, by the D-A converter 15, amplified by the amplifier 16 and converted to an acoustic output by the acoustic transducer 17.

FIG. 13 shows another embodiment of the present invention in which an electronic musical instrument comprises a first tone composing means 202 for producing a digital tone signal 204, a second tone composing means 206 for producing a digital tone signal 208, and a summing means 210 for summing both of the digital tone signals 204 and 208 to feed a mixed digital tone signal 212 to a D-A converter as has been shown in FIG. 1. The digital tone composing means 202 and 206 are similar in construction and operation to the one shown and described hereinbefore, and produces the digital tone signals 204 and 208, respectively, which are different in their amplitude from each other. These digital tone signal 204 and 208 are mixed together at summing means 210, whereby the digital tone signal 212 capable of representing the timbre different from that represented by the signals 204 or 208 can be obtained. The digital tone signal 212 is then analog-converted, amplified and converted to the corresponding acoustic information or musical tone. In a similar manner, a tone of the desired timbre can be produced in case where three or more digital tone composing means are provided at the preceeding stage of the summing means 210.

Several preferred embodiments of the present invention are fully explained above. According to the present invention the following excellent function and effect can be obtained.

(1) Since the waveform composition is carried out by a logical operation without using a waveform storing ROM, the hardware volume is minimized.

(2) Square operation, and the multiplication of the squared result and envelope data, are executed in a common serial multiplication circuit and so, coupled with the preceding point (1), an efficient use of hardware becomes possible and reduction of the hardware volume is achieved.

(3) The waveform approximated by squared curves is expressed in such a functional form as:

$$f(x) = 32/\pi 3\,(\sin x + 1/3\ 3\sin 3\,x + 1/5\ 3\sin 5\,x + 1/7\ 3\sin 7\,x + \ldots)$$

It is seen that such waveform substantially approaches a sine wave.

(4) By generating a plurality of such sine waves at suitable amplitudes and combining them together, a tone of any timbre can be produced easily.

It should be apparent to one skilled in the art that the above described embodiments are merely illustrative of but a few of the many possible specific embodiments which represent the application the principles of the present invention. Numerous and varied other arrangements can be readily devised by those skilled in the art without departing from the spirit and scope of the invention.

What is claimed is:

1. A method of composing a digital tone signal comprising the steps of:

squaring a digital phase progress signal defining which values vary at a substantially constant rate determined in accordance with a frequency of a note; and applying a coordinate conversion process to said digital phase progress signal to convert the coordinate of said values at each phase so as to form a digital tone signal representing a sinusoidal wave approximated by alternately connecting downwardly opening and upwardly opening parabolic curves at the open ends of said parabolic curves.

2. A method of composing a digital tone signal, as defined in claim 1, further comprising the step of multiplying said digital tone signal by a digital envelope signal representing a keying envelope.

3. A method of composing a digital tone signal comprising the steps of:

generating a plurality of digital tone signals each representing a sinusoidal wave approximated by alternately connecting downwardly opening and upwardly opening parabolic curves at the open ends of said curves; and summing said plurality of digital tone signals to form a mixed digital tone signal of a timbre different from those of said plurality of digital tone signals.

4. A method of composing a digital tone signal, as defined in claim 3, wherein each of said plurality of digital tone signals is formed by applying a coordinate conversion and a squaring operation process to a digital phase progress signal specifying in digital words values varying at a substantially constant rate determined in accordance with a frequency of a note.

5. An apparatus for composing a digital tone signal comprising:

means for generating a digital phase progress signal specifying in digital words values varying at a substantially constant rate determined in accordance with a frequency of a note;

a serial multiplication circuit for receiving multiplicand and multiplier inputs to produce a serial product output;

means for executing coordinate conversion on said digital phase progress signal to convert the coordinate of said values so as to form a digital tone signal representing a sinusoidal wave approximated by alternately connecting downward opening and upwardly opening parabolic curves at the open ends of said curves;

means for generating a digital envelope signal indicative of a keying envelope; and means for successively feeding to said serial multiplication circuit a first set of multiplicand and multiplier inputs each consisting of said digital phase progress signal and a second set of multiplicand and multiplier inputs, the former consisting of said digital tone signal while the latter consists of said digital envelope signal so that said serial product output is obtained as an output representing a waveform wherein the approximate sinusoidal wave is amplitude-modulated with said keying envelope.

6. An apparatus for composing a digital tone signal, as defined in claim 5, wherein said serial multiplication circuit comprises:

an arithmetic circuit for calculating a partial product, a partial sum and a partial carry for each digit of the multiplicand and multiplier inputs;

an effective digit store circuit for storing the data of the partial sums and partial carries belonging to the predetermined effective digits of a product; and an addition output circuit for summing the partial products, partial sums and partial carries belonging to the effective digits to produce said serial product output representing said product, said digital tone signal and said digital envelope signal being fed as said second set of multiplicand and multiplier inputs to said arithmetic circuit after a time when data of the partial sums and partial carries of the effective digits calculated in squaring said digital tone signal are transferred from said arithmetic circuit to said effective digit store circuit to be stored therein.

* * * * *